US010669504B2

(12) United States Patent
Shamszad et al.

(10) Patent No.: US 10,669,504 B2
(45) Date of Patent: Jun. 2, 2020

(54) SEAL SWELL AGENTS FOR LUBRICATION COMPOSITIONS

(71) Applicant: The Lubrizol Corporation, Wickliffe, OH (US)

(72) Inventors: Mariam Shamszad, Willoughby, OH (US); Paul E. Adams, Willoughby, OH (US); Mahmud M. Hussain, Ann Arbor, MI (US); Peter Miatt, Allestree (GB)

(73) Assignee: The Lubrizol Corporation, Wickliffe, OH (US)

( * ) Notice: Subject to any disclaimer, the term of this patent is extended or adjusted under 35 U.S.C. 154(b) by 84 days.

(21) Appl. No.: 15/748,552

(22) PCT Filed: Jul. 26, 2016

(86) PCT No.: PCT/US2016/043973

§ 371 (c)(1),
(2) Date: Jan. 29, 2018

(87) PCT Pub. No.: WO2017/019654

PCT Pub. Date: Feb. 2, 2017

(65) Prior Publication Data

US 2018/0223214 A1 Aug. 9, 2018

Related U.S. Application Data

(60) Provisional application No. 62/197,659, filed on Jul. 28, 2015, provisional application No. 62/197,668, filed on Jul. 28, 2015.

(51) Int. Cl.

| | |
|---|---|
| ***C07D 207/26*** | (2006.01) |
| ***C07D 233/16*** | (2006.01) |
| ***C10M 135/08*** | (2006.01) |

(52) U.S. Cl.

CPC .. *C10M 135/08* (2013.01); *C10M 2203/1006* (2013.01); *C10M 2203/1025* (2013.01); *C10M 2205/0285* (2013.01); *C10M 2205/173* (2013.01); *C10M 2207/026* (2013.01); *C10M 2207/028* (2013.01); *C10M 2207/122* (2013.01); *C10M 2215/064* (2013.01); *C10M 2215/28* (2013.01); *C10M 2215/30* (2013.01); *C10M 2219/022* (2013.01); *C10M 2219/04* (2013.01); *C10M 2219/046* (2013.01); *C10M 2223/045* (2013.01); *C10N 2230/36* (2013.01); *C10N 2230/42* (2013.01); *C10N 2230/45* (2013.01); *C10N 2230/52* (2013.01); *C10N 2240/04* (2013.01); *C10N 2240/10* (2013.01); *C10N 2240/104* (2013.01); *C10N 2240/12* (2013.01); *C10N 2240/30* (2013.01)

(58) Field of Classification Search

CPC ..... C10M 135/08
USPC ..... 508/286, 569
See application file for complete search history.

(56) References Cited

U.S. PATENT DOCUMENTS

| | | | | |
|---|---|---|---|---|
| 3,654,323 | A | 4/1972 | Clark | |
| 4,029,587 | A | 6/1977 | Koch | |
| 6,555,700 | B1 | 4/2003 | Horrobin et al. | |
| 6,667,285 | B1 * | 12/2003 | Kawahara | C09K 5/045 252/68 |
| 2007/0213239 | A1 * | 9/2007 | Kaneko | C09K 5/042 508/567 |
| 2009/0186787 | A1 * | 7/2009 | Scherer | C10M 105/42 508/304 |

FOREIGN PATENT DOCUMENTS

| | | |
|---|---|---|
| GB | 1229484 | 4/1971 |
| GB | 1328060 | 8/1973 |

OTHER PUBLICATIONS

Search Report of Corresponding International Application No. PCT/US2016/026554 dated Jul. 4, 2016.
Written Opinion of Corresponding International Application No. PCT/US2016/026554 dated Jul. 4, 2016.

* cited by examiner

*Primary Examiner* — Prem C Singh
*Assistant Examiner* — Francis C Campanell
(74) *Attorney, Agent, or Firm* — Vincent Cortese; Teresan W. Gilbert; Teresa W. Gilbert, OH Reg. No

(57) ABSTRACT

The invention relates to a seal swell agent which is a substituted sulfonyldibenzene compound, and lubricating compositions containing the seal swell agent. The substituents on the benzene rings may be hydrocarbyl groups of 4 to 20 carbon atoms or alkylene groups of 1-2 carbon atoms with further functional groups.

18 Claims, No Drawings

SEAL SWELL AGENTS FOR LUBRICATION COMPOSITIONS

CROSS REFERENCE TO RELATED APPLICATION

This application claims priority from PCT Application No. PCT/US2016/043973 filed Jul. 26, 2016, which claims the benefit of U.S. Provisional Applications No. 62/197,659 filed Jul. 28, 2015 and 62/197,668 filed Jul. 28, 2015.

BACKGROUND

The disclosed technology relates to compounds that are useful as seal swell agents in lubricant compositions. Also disclosed are lubricating compositions and concentrates comprising said seal swell agents and to the use of such lubricating compositions and concentrates.

Rubber seals are critically important to the proper operation of many engines, power transmission devices, pumps, gears and bearings. Seal performance tends to deteriorate with use and age; seals tend to degrade, harden, shrink and then leak. Preserving the integrity of seals in such devices is desirable, in order to lower maintenance costs of the operation and to prevent unexpected loss or leakage of lubricant that could result in catastrophic mechanical failure.

It is known to introduce seal swelling additives into functional fluids used in machinery in order to alleviate the problems of seal shrinkage and subsequent leakage of the functional fluid. The enhancement of swelling or apparent regeneration of elastomeric seals in machinery and equipment aids the prevention of leakage due to shrinkage of seals over time.

US 2007/0087947 A1 (Michael Glasgow et al., published on 19 Apr. 2007) discloses an additive composition which comprises at least one dispersant viscosity index improver and at least two seal swell additives. The two seal swell additives can be selected from oil-soluble esters and oil soluble sulfones such as the sulfolane seal well agents disclosed in U.S. Pat. Nos. 4,029,587 and 4,029,588.

U.S. Pat. No. 7,727,944 B2 (Edward J. Konzman et al., published on 1 Jun. 2010) discloses an additive composition which comprises a combination of conditioning agents for preserving the integrity of elastomeric materials. The composition can comprise as component (B), a second seal-conditioning agent which is a seal swell agent selected from the group consisting of sulfolanes, benzyl esters, lactones, nitriles and hindered phenolic materials.

There is a need for new lubricating compositions (lubricants) that have excellent seal swelling properties. There is a need for new compounds that can act as seal swell agents in lubricants and that impart excellent seal compatibility and, in particular, seal swelling properties to said lubricants.

SUMMARY OF THE INVENTION

The disclosed technology provides a compound represented by formula (I)

(I)

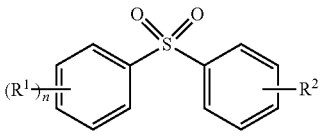

wherein:

n is 0 or 1;

$R^1$ and $R^2$ are each independently a group represented by $R^3$ or $R^4{}_p$—Y;

$R^3$ is a hydrocarbyl group containing about 4 to about 20 carbon atoms;

$R^4$ is an alkylene group containing about 1 or 2 carbon atoms;

p is 0 or 1;

—Y is —Z—$R^5$ where —Z— is chosen from —NH—, —N($R^6$)— where $R^6$ is a hydrocarbyl group containing from about 6 to about 18 carbon atoms, —N═CH—, —HC═N—, —O—C(O)—C(O)—O—, and $R^5$ is hydrogen or an aliphatic hydrocarbyl group containing about 4 to about 20 carbon atoms;

or —Y is represented by formula (II)

(II)

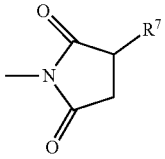

where $R^7$ is a hydrocarbyl group containing from about 8 to about 100 carbon atoms.

The inventors have found that the compound of formula (I) can impart exceptional seal swelling properties to an oil of lubricating viscosity. Lubricating compositions comprising a compound of formula (I) have excellent compatibility with elastomeric seals and are particularly effective at swelling such seals. It follows that a compound of formula (I) can be used as seal swell agent in a lubricating composition or functional fluid (lubricant) at a relatively low treat rate. This is advantageous for functional fluids comprising base oils with little natural seal swelling properties, such as synthetic gas-to-liquid oils, and which generally require a relatively high amount of seal swell additive to achieve seal swelling properties.

The invention further provides a lubricating composition comprising a compound of formula (I), a method of preparing such a lubricating composition, a method of lubricating a mechanical device using said composition, and the use of a compound of formula (I) as a seal swelling or seal swell agent in a lubricating composition.

DETAILED DESCRIPTION OF THE INVENTION

Various preferred features and embodiments will be described below by way of non-limiting illustration.

The disclosed technology provides a compound of formula (I)

(I)

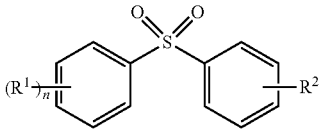

wherein:

n is 0 or 1;

$R^1$ and $R^2$ are each independently a group represented by $R^3$ or $R^4{}_p$—Y;

$R^3$ is a hydrocarbyl group containing about 4 or about 12 to about 20, about 6 to about 18, about 6 to about 14 or about 6 to about 8 carbon atoms;

$R^4$ is an alkylene group containing about 1 or 2 carbon atoms;

p is 0 or 1;

—Y is —Z—$R^5$ where —Z— is chosen from —NH—, —N($R^6$)— where $R^6$ is a hydrocarbyl group containing from about 6 to about 18 carbon atoms, —N═CH—, —HC═N—, —O—C(O)—, —C(O)—O—, and $R^5$ is hydrogen or an aliphatic hydrocarbyl group containing about 4 or about 12 to about 20, about 6 to about 18, about 6 to about 14, or about 6 to about 8 carbon atoms;

or —Y is represented by formula (II)

(II)

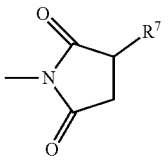

where $R^7$ is a hydrocarbyl group containing from about 8 to about 100, about 12 to about 24, about 8 to about 16, about 14 to about 16 or about 40 to about 70 carbon atoms.

In one embodiment, the compound of the invention is represented by formula (I) with the proviso that when n is 1 and $R^1$ and $R^2$ are each the same and are represented by $R^4_p$—Z—$R^5$, Z is chosen from —NH—, —N($R^6$)—, —N═CH—, —HC═N—; and (i) when Z is —N═CH— $R^5$ is (a) not hydrogen nor an alkyl group containing 6, 9 or 10 carbon atoms and/or (b) $R^5$ is a hydrocarbyl group containing from 12 to 20 carbon atoms; and (ii) when Z is —NH—, $R^5$ is a hydrocarbyl group containing from about 6 to about 20 carbon atoms.

$R^1$ is optionally present in formula (I) and, like $R^2$ (but independently of $R^2$), is either a $R^3$ group or a $R^4_p$—Y group. $R^1$ and $R^2$ can be different groups or the same group. $R^1$ and $R^2$ can each independently occupy the 2, 3 or 4 position on their respective benzene rings, where the carbon attached to the sulphur atom is considered to occupy the 1 position. $R^1$ and $R^2$ can each occupy the same position on the benzene ring or can each occupy a different position on the benzene ring. In one embodiment, at least one of $R^1$ and $R^2$ is represented by the group $R^4_p$—Y, i.e., the compound of formula (I) contains at least one of a $R^1$ group represented by the group $R^4_p$—Y or a $R^2$ group represented by the group $R^4_p$—Y. In one embodiment, n is 1 and at least one of $R^1$ and $R^2$ is represented by the group $R^4_p$—Y. Alternatively, $R^2$ may be further substituted on the benzene ring.

$R^3$ is a hydrocarbyl group containing from about 4 or about 12 to about 20, about 6 to about 18, about 6 to about 14, or about 6 to about 8 carbon atoms. In one embodiment, $R^3$ is an aliphatic hydrocarbyl group, for example an alkyl group of about 4 or 12 to about 20, about 6 to about 18, about 6 to about 14 or about 6 to about 8 carbon atoms. The hydrocarbyl group can be linear or branched. In one embodiment, $R^3$ does not contain any aromatic or non-aromatic ringed structures.

$R^4$ is optionally present and is an alkylene group having 1 or 2 carbon atoms, i.e., —$CH_2$— or —$C_2H_4$—. When $R^4$ is not present, i.e., when p=0, then $R^1$ and $R^2$ are each independently a group represented by $R^3$ or Y.

—Y can be —Z—$R^5$ where $R^5$ is hydrogen or an aliphatic hydrocarbyl group of about 4 or 12 to about 20, about 6 to about 18, about 6 to about 14 or about 6 to about 8 carbon atoms and —Z— is chosen from —NH—, —N($R^6$)— where $R^6$ is a hydrocarbyl group containing from about 6 to about 18 carbon atoms, —N═CH—, —HC═N—, —O—C(O)— and —C(O)—O—. $R^6$ can be an aliphatic hydrocarbyl group such as a branched or linear alkyl group. In one embodiment, at least one of $R^1$ and $R^2$ is represented by the group $R^4_p$—Z—$R^5$. In one embodiment, Z is chosen from —NH—, —N($R^6$)—, —N═CH—, —HC═N—. In one embodiment, —Z— is chosen from —NH—, —N═CH— and —O—C(O)—. The Z group has: a terminal nitrogen atom when —Z— is one of —NH—, —N($R^6$)— and —HC═N—; a terminal oxygen atom when —Y— is —C(O)—O—; and a terminal carbon atom when —Y— is one of —N═CH— and —O—C(O)—. $R^5$ is hydrogen, or an aliphatic hydrocarbyl group of about 4 or 12 to 20, 6 to 18, 6 to 14 or 6 to 8 carbon atoms, for example an alkyl group having about 4 or 12 to 20, 6 to 18, 6 to 14 or 6 to 8 carbon atoms. The hydrocarbyl group may be branched or linear. In one embodiment, the hydrocarbyl group does not contain any ringed structures. In one embodiment $R^5$ is a branched alkyl group, such as a C8-alkyl group, with branching at the beta position with respect to the terminal nitrogen or oxygen atom in Z. The beta position is the second carbon from the terminal nitrogen or oxygen atom. In one embodiment $R^5$ is a branched alkyl group, such as a C8-alkyl group, with branching at the alpha position with respect to the terminal carbon atom in Z. The alpha position is the first carbon from the terminal carbon atom.

—Y can be represented by formula (II), (II)

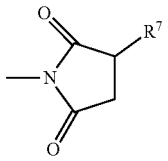

where $R^7$ is a hydrocarbyl group containing from about 8 to about 100, about 12 to about 24, about 8 to about 16, about 14 to about 16 or about 40 to about 70 carbon atoms. In an exemplary embodiment, $R^7$ is a hydrocarbyl group containing from about 14 to about 16 carbon atoms. The hydrocarbyl group can be linear or branched. In one embodiment, $R^7$ does not contain any aromatic or non-aromatic ringed structures, and in some embodiments $R^7$ may be attached through a linkage that involves a non-aromatic ring structure. $R^7$ can be an aliphatic hydrocarbyl group, for example an alkyl group, of about 8 to about 100, about 12 to about 24, about 8 to about 16, about 14 to about 16 or about 40 to about 70 carbon atoms. $R^7$ can be alkyl group which may be branched or linear. In one embodiment, $R^7$ is derived from a polyolefin, for example polyisobutene, polyethylene or polypropylene. In an exemplary embodiment $R^7$ is derived from polyisobutene (PIB) having a molecular weight of 1000 ($R^7$ thus will contain about 70 carbon atoms).

In one embodiment of formula (I), at least one of $R^1$ and $R^2$ contains a hydrocarbyl group which contains at least 4, 5, 6, 7 or 8 carbon atoms, i.e., the compound of formula (I) comprises at least one of a $R^1$ group which contains at least 4, 5, 6, 7 or 8 carbon atoms or a $R^2$ group which contains at least 4, 5, 6, 7 or 8 carbon atoms. When n=0, this condition is satisfied when $R^2$ contains a hydrocarbyl group which contains at least 4, 5, 6, 7 or 8 carbon atoms. $R^1$ or $R^2$ contains a hydrocarbyl group having at least 4 carbon atoms when $R^1$ or $R^2$ is an $R^3$ group, or when $R^1$ or $R^2$ contains (i) a $R^5$ group that is a hydrocarbyl group, (ii) a $R^6$ group, or (iii) a $R^7$ group. $R^1$ or $R^2$ contains a hydrocarbyl group having at least 5 carbon atoms when $R^1$ or $R^2$ is an $R^3$ group which contains at least 5 carbon atoms, or when $R^1$ or $R^2$ contains (i) a $R^5$ group that is a hydrocarbyl group which contains at least 5 carbon atoms, (ii) a $R^6$ group, or (iii) a $R^7$ group. $R^1$ or $R^2$ contains a hydrocarbyl group having at least 6 carbon atoms when $R^1$ or $R^2$ is an $R^3$ group which contains at least 6 carbon atoms, or when $R^1$ or $R^2$ contains (i) a $R^5$ group that is a hydrocarbyl group which contains at least 6 carbon atoms, (ii) a $R^6$ group, or (iii) a $R^7$ group. $R^1$ or $R^2$ contains a hydrocarbyl group having at least 7 carbon atoms when $R^1$ or $R^2$ is an $R^3$ group which contains at least 7 carbon atoms, or when $R^1$ or $R^2$ contains (i) a $R^5$ group that is a hydrocarbyl group which contains at least 7 carbon atoms, (ii) a $R^6$ group which contains at least 7 carbon atoms, or (iii) a $R^7$ group. $R^1$ or $R^2$ contains a hydrocarbyl group having at least 8 carbon atoms when $R^1$ or $R^2$ is an $R^3$ group which contains at least 8 carbon atoms, or when $R^1$ or $R^2$ contains (i) a $R^5$ group that is a hydrocarbyl group which contains at least 8 carbon atoms, (ii) a $R^6$ group which contains at least 8 carbon atoms, or (iii) a $R^7$ group.

In one embodiment, preferably, n=1 giving a compound having the following structure:

(Ia)

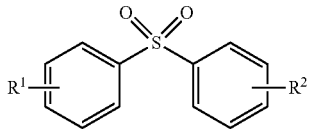

In this embodiment both the $R^1$ and $R^2$ groups can be the same and can optionally occupy the same position on their respective benzene rings, for example, optionally, they both can occupy the 2 position, the 3 position or the 4 position. In one embodiment, both $R^1$ and $R^2$ are represented by $R^4_p$—Z—$R^5$ as defined above, where p is 0, —Z— is —NH—, —N═CH— or —O—C(O)— and $R^5$ is a C8 to C10 linear or branched alkyl group, for example a heptyl group, a 1-ethyl pentyl group, a octyl group, a 2-ethylhexyl group, a nonyl group or a decyl group. In one embodiment Y is represented by formula (II) and $R^7$ is a C12 or C14 to C16 aliphatic hydrocarbyl group such as a hexadecenyl group.

In one embodiment, at least one of the $R^1$ and $R^2$ groups present is free of tertiary butyl substituents. In one embodiment, both the $R^1$ group and the $R^2$ group are free of tertiary butyl substituents. Example compounds according to formula (I) are shown in Table 1.

TABLE 1

| Cpd | Structure | Name |
|---|---|---|
| A | 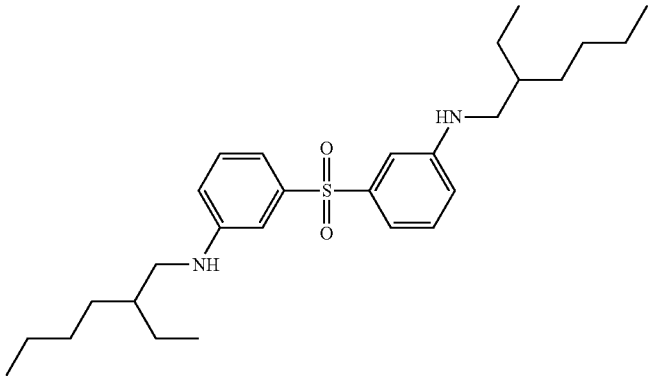 | 3,3'-sulfonylbis(N-(2-ethylhexyl)aniline) |
| B | 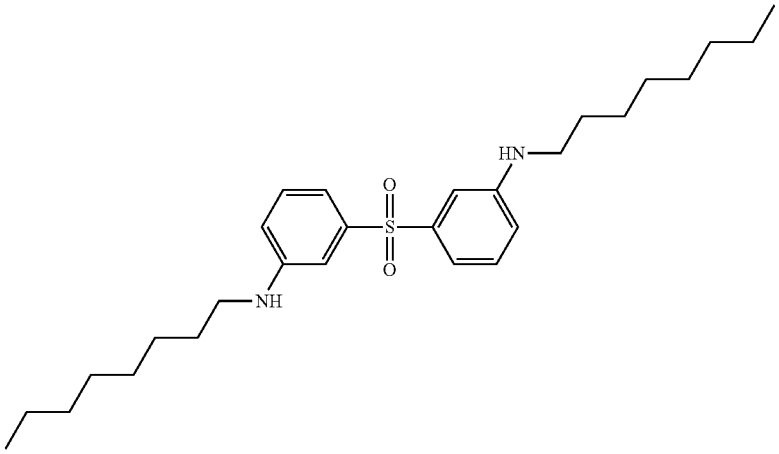 | 3,3'-sulfonylbis(N-octylaniline) |

TABLE 1-continued
| Cpd | Structure | Name |
|---|---|---|
| C | 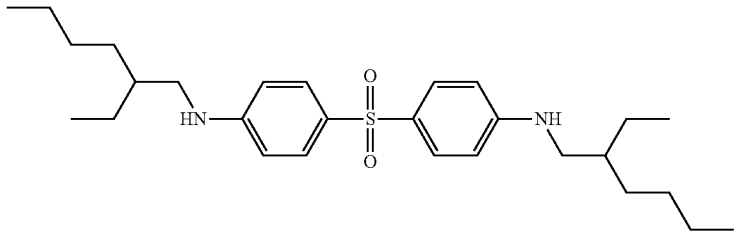 | 4,4'-sulfonylbis(N-(2-ethylhexyl)aniline) |
| D | 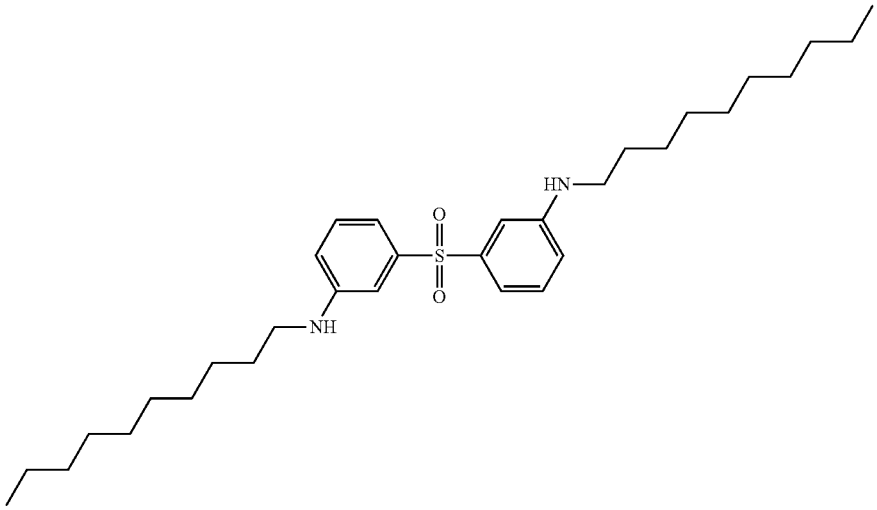 | 3,3'-sulfonylbis(N-decylaniline) |
| E | 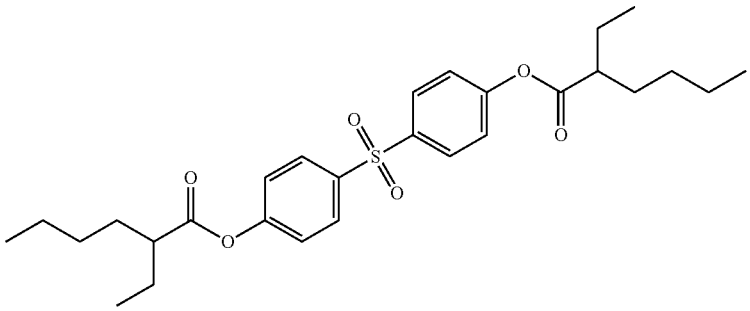 | Sulfonylbis(4,1-phenylene) bis(2-ethylhexanoate) |
| F | 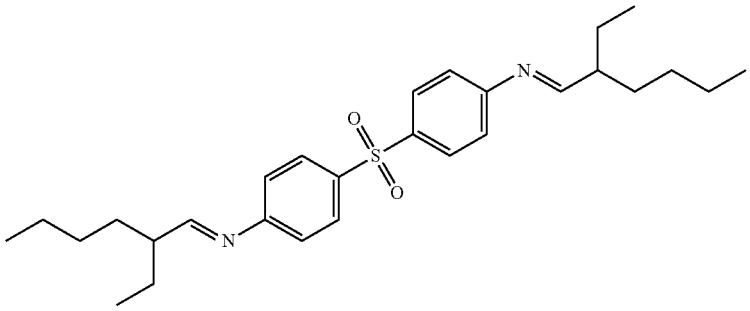 | (NE,N'E)-4,4'-sulfonylbis(N-(2-ethylhexylidene)aniline) |

TABLE 1-continued

| Cpd | Structure | Name |
|---|---|---|
| G | 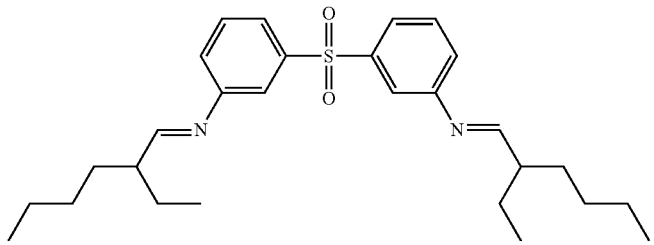 | (NE,N'E)-3,3'-sulfonyl-bis(N-(2-ethyl-hexylidene)aniline) |
| H | 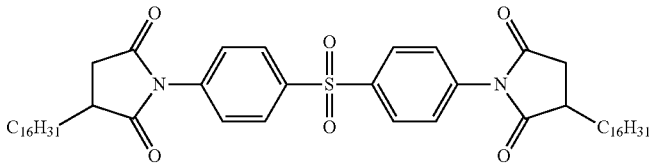 | 1,1'-(sulfonylbis(4,1-phenylene))bis(3-hexadecenyl-pyrrolidine-2,5-di-one) |
| I | 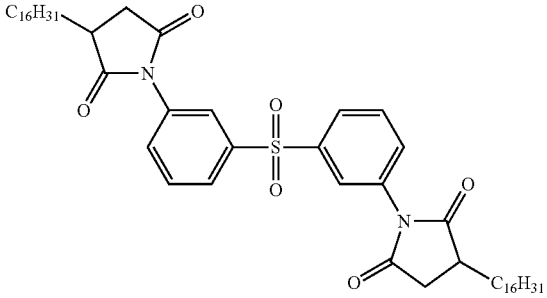 | 1,1'-(sulfonylbis(3,1-phenylene))bis(3-hexa-decenylpyrrolidine-2,5-dione) |

These compounds can be prepared by means known in the art, for example, condensations, esterifications, reductive aminations, etherifications, alkylations, nucleophilic substitutions/displacement reactions reactions, Michael addition reactions, nucleophilic aromatic substitutions, electrophilic aromatic substitutions, carbonyl addition reactions, etc.

It has been found that compounds of formula (I) can be used to improve the seal compatibility of a lubricating composition and, in particular, to impart seal swelling properties to a lubricating composition such as an functional fluid, for example, a driveline oil (such as an automatic transmission fluid) or an engine oil, or a lubricating composition such as, for example, a grease, or a lubricating composition for use in a hydraulic system, turbine system, circulating oil system, industrial gears, gas compressor or refrigeration system.

The present technology provides a composition which comprises, as one component, an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene-isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid (GTL) synthetic procedure as well as other gas-to-liquid (GTL) oils.

GTL base oils include base oils obtained by one or more possible types of GTL processes, typically a Fischer-Tropsch process. The GTL process takes natural gas, predominantly methane, and chemically converts it to synthesis gas, or syngas. Alternatively, solid coal can also be converted into synthesis gas. Synthesis gas mainly contains carbon monoxide (CO) and hydrogen ($H_2$), which are mostly subsequently chemically converted to paraffins by a catalytic Fischer-Tropsch process. These paraffins will have a range of molecular weights and by the use of catalysts can be hydroisomerised to produce a range of base oils. GTL base stocks have a highly paraffinic character, typically greater than 90% saturates. Of these paraffinics, the non-cyclic paraffinic species predominate over the cyclic paraffinic species. For example, GTL base stocks typically comprise greater than 60 wt %, or greater than 80 wt %, or greater than 90 wt % non-cyclic paraffinic species. GTL base oils typically have a kinematic viscosity at 100° C. of between 2 cSt and 50 cSt, or 3 cSt to 50 cSt, or 3.5 cSt to 30 cSt. The GTL exemplified in this instance has a kinematic viscosity at 100° C. of about 4.1 cSt. Likewise, the GTL base stocks are typically characterised as having a viscosity index (VI, refer to ASTM D2270) of 80 or greater, or 100 or greater, or 120 or greater. The GTL exemplified in this instance has a VI of 129. Typically GTL base fluids have effectively zero sulphur and nitrogen contents, generally less than 5 ppm of each of these elements. GTL base stocks are Group III oils, as classified by the American Petroleum Institute (API).

Poly-alpha olefin base oils (PAOs), and their manufacture, are generally well known. With regards PAOs, the PAO base oils may be derived from linear C2 to C32, preferably C4 to C16, alpha olefins. Particularly preferred feedstocks for PAOs are 1-octene, 1-decene, 1-dodecene and 1-tetradecene. The PAO exemplified in this instance has a kinematic viscosity at 100° C. of about 3.96 cSt and a VI of 101. The oil of lubricating viscosity may be an API Group IV oil, or mixtures thereof, i.e., a polyalphaolefin. The polyalphaolefin may be prepared by metallocene catalyzed processes or from a non-metallocene process.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80 to less than 120); Group II (sulfur content ≤0.03 wt %, and ≥90 wt % saturates, viscosity index 80 to less than 120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity may comprise an API Group I, Group II, Group III, Group IV, Group V oil or mixtures thereof.

Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

In one embodiment, the oil of lubricating viscosity has little natural ability to swell seals, for example, a PAO or GTL oil. Both PAO and GTL base stocks are highly paraffinic in nature (low levels of aromaticity). PAOs are 100% isoparaffinic with essentially zero percent aromatics. Likewise, GTL base oils have a very highly paraffinic content and again, essentially zero aromatic content. As a result, both PAO and GTL base oils are regarded as having low solvency and poor lubricant additive solubility performance. They also exhibit little natural ability to swell seals.

The amount of the oil of lubricating viscosity present is typically the balance remaining after subtracting from 100 wt % the amount of the compound of formula (I) and, when present, other performance additives. The composition may be in the form of a concentrate or a fully formulated lubricant. If the composition is in the form of a fully formulated lubricant, typically the oil of lubricating viscosity, including any diluent oil present in the composition, will be present in an amount of from 70 to 95 wt %, or from 80 or 85 to 93 wt %. If the lubricating composition of the invention is in the form of a concentrate (which may then be combined with additional oil to form, in whole or in part, a finished lubricant), typically the oil of lubricating viscosity, including any diluent oil present in the composition, will be present in an amount of from 0.1 wt % to 40 wt % or 0.2 wt % to 35 wt % or 0.4 wt % to 30 wt % or 0.6 wt % to 25 wt % or 0.1 wt % to 15 wt % or 0.3 wt % to 6 wt %.

In some embodiments, the compositions of the invention are lubricating compositions which can include a compound of formula (I) in an amount from 0.01 or 0.05 to 2 wt %, or 0.01 or 0.05 to 1.5 wt %, 0.05 to 1 wt %, 0.15 to 1 wt %, 0.15 to 0.5 wt % of the overall composition on an oil free basis. If the oil of lubricating viscosity is one which has little natural ability to swell seals such as a gas to liquid oil or a polyalphaolefin, then more seal swell agent of the present invention may be needed and the lubricating composition may include a compound of formula (I) in an amount from 0.35 to 1.5 wt %, 0.35 to 1.25 wt %, 0.35 to 0.8 wt %, 0.4 to 0.6 wt % of the overall composition on an oil free basis. The balance of these lubricating compositions may be one or more additional additives as described below and a major amount of oil of lubricating viscosity including any diluent oil or similar material carried into the composition from one or more of the components described herein. By major amount is meant greater than 50 wt % based on the composition.

In some embodiments, the compositions of the invention are concentrates, which can also be referred to as additive concentrates or additive compositions, which can include a compound of formula (I) in an amount from 2 to 30 wt %, 4 to 25 wt % or 7.5 to 22 wt % of the overall composition on an oil free basis. These ranges are especially typical for concentrates for Off Highway (OH) applications. The balance of these compositions may be one or more additional additives as described below, and a minor amount of lubricating oil including any diluent oil or similar material carried into the composition from one or more of the components described herein. By minor amount is meant 50 wt % or less than 50 wt % based on the composition.

The invention provides for the use of such additive concentrates as seal swelling additives in a lubricating composition such as a functional fluid.

Other components may be present in amounts which are suitable to the end use to which the lubricant is to be employed. Lubricants (or functional fluids) for driveline devices such as automatic transmissions will typically have their own spectrum of additives; similarly lubricants (or functional fluids) for engine oils (passenger car, or heavy duty diesel, or marine diesel, or small two-cycle) and lubricants with industrial applications (such as a grease, or a lubricating composition for use in a hydraulic system, turbine system, circulating oil system, industrial gears, gas compressor or refrigeration system) will each have their characteristic additives, which are well known to those skilled in the art of lubricating such devices. In general, lubricant formulations can optionally include any of the following additives:

Dispersants

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Another class of dispersant is high molecular weight esters. These materials are similar to Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Aromatic succinate esters may also be prepared as described in United States Patent Publication 2010/0286414. Other dispersants include polymeric dispersant additives, which are generally hydrocarbon-based polymers which contain polar functionality to impart dispersancy characteristics to the polymer.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521; dispersants made in this manner are often derived from high vinylidene (i.e., greater than 50% terminal vinylidene) polyisobutylene (see col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Dispersants may be derived from, as the polyolefin, high vinylidene polyisobutylene, that is, having greater than 50, 70, or 75% terminal vinylidene groups (α and β isomers). In certain embodiments, a succinimide dispersant may be prepared by the direct alkylation route. In other embodiments it may comprise a mixture of direct alkylation and chlorine-route dispersants.

A preferred class of dispersants is the carboxylic dispersants. Carboxylic dispersants include succinic-based dispersants, which are the reaction product of a hydrocarbyl substituted succinic acylating agent with an organic hydroxy compound or, in certain embodiments, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. Nos. 4,234,435 and 3,172,892.

Succinic based dispersants have a wide variety of chemical structures including typically structures such as

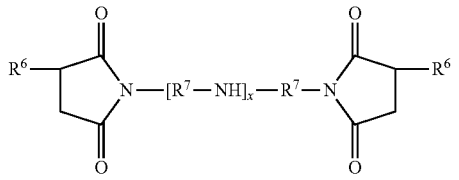

wherein each $R^6$ is independently a hydrocarbyl group, such as a polyolefin-derived group having an $\overline{M}_n$ of 500 or 700 to 10,000. Typically the hydrocarbyl group is an alkyl group, frequently a polyisobutyl group with a molecular weight of 500 or 700 to 5000, or in another embodiment, 1500 or 2000 to 5000. Alternatively expressed, the $R^6$ groups can contain 40 to 500 carbon atoms and in certain embodiments at least 50, e.g., 50 to 300 carbon atoms, such as aliphatic carbon atoms. Each $R^6$ group may contain one or more reactive groups, e.g., succinic groups. The $R^7$ are alkenyl groups, commonly —$C_2H_4$— groups. Such molecules are commonly derived from reaction of an alkenyl acylating agent with a polyamine, and a wide variety of linkages between the two moieties is possible beside the simple imide structure shown above, including a variety of amides and quaternary ammonium salts. Likewise a variety of modes of attachment of the $R^6$ groups are contemplated, including linkages involving cyclic (non-aromatic ring) structures.

The amines which are reacted with the succinic acylating agents to form the carboxylic dispersant composition can be monoamines or polyamines. Polyamines include principally alkylene polyamines such as ethylene polyamines (i.e., poly(ethyleneamine)s), such as ethylene diamine, triethylene tetramine, propylene diamine, decamethylene diamine, octamethylene diamine, di(heptamethylene) triamine, tripropylene tetramine, tetra-ethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamines is particularly useful.

Hydroxyalkyl-substituted alkylene amines, i.e., alkylene amines having one or more hydroxyalkyl substituents on the nitrogen atoms, likewise are useful, as are higher homologues obtained by condensation of the above-illustrated alkylene amines or hydroxy alkyl-substituted alkylene amines through amino radicals or through hydroxy radicals.

In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Hunstman Corporation located in Houston, Tex.

Post-treated dispersants may also be a part of the disclosed technology. They are generally obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Amine dispersants are reaction products of relatively high molecular weight aliphatic or alicyclic halides and mines, such as polyalkylene polyamines. Examples thereof are described in the U.S. Pat. Nos. 3,275,554, 3,438,757, 3,454,555, and 3,565,804. In certain embodiments one or more of the individual dispersants may be post-treated with boron or DMTD or with both boron and DMTD. Exemplary materials of these kinds are described in the following U.S. patents: U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

The amount of the dispersant in a completely formulated lubricant, if present, will typically be 0.05 or 0.5 to 10 percent by weight, or 1 to 8 percent by weight, or 3 to 7 percent by weight or 2 to 5 percent by weight. Its concentration in a concentrate will be correspondingly increased, to, e.g., 5 to 80 weight percent.

Detergents

Detergents are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The overbased compositions can be prepared based on a variety of well known organic acidic materials including sulfonic acids, carboxylic acids (including substituted salicylic acids), phenols, phosphonic acids, saligenins, salixarates, and mixtures of any two or more of these. These materials and methods for overbasing of them are well known from numerous U.S. patents.

The basically reacting metal compounds used to make these overbased salts are usually an alkali or alkaline earth metal compound, although other basically reacting metal compounds can be used. Compounds of Ca, Ba, Mg, Na and Li, such as their hydroxides and alkoxides of lower alkanols are usually used. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the above-described saligenin derivative.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, e.g., $CO_2$ or mixtures thereof, e.g., mixtures of $CO_2$ and acetic acid.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Overbased saligenin derivatives are described in PCT publication WO 2004/048503; overbased salixarates are described in PCT publication WO 03/018728.

Overbased sulphonates typically have a TBN of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

In one embodiment, the sulfonate detergent may be a branched alkylbenzene sulfonate detergent. Branched alkylbenzene sulfonate may be prepared from isomerized alpha olefins, oligomers of low molecular weight olefins, or combinations thereof. Preferred oligomers include tetramers, pentamers, and hexamers of propylene and butylene. In other embodiments, the alkylbenzene sulfonate detergent may be derived from a toluene alkylate, i.e., the alkylbenzene sulfonate has at least two alkyl groups, at least one of which is a methyl group, the other being a linear or branched alkyl group as described above.

In one embodiment the lubricating composition further comprises a non-sulphur containing phenate, or sulphur containing phenate, or mixtures thereof. The non-sulphur containing phenates and sulphur containing phenates and known in the art. The non-sulphur containing phenate, or sulphur containing phenate may be neutral or overbased. Typically an overbased non-sulphur containing phenate, or a sulphur containing phenate have a total base number of 180 to 450 TBN and a metal ratio of 2 to 15, or 3 to 10. A neutral non-sulphur containing phenate, or sulphur containing phenate may have a TBN of 80 to less than 180 and a metal ratio of 1 to less than 2, or 0.05 to less than 2.

The non-sulphur containing phenate, or sulphur containing phenate may be in the form of a calcium or magnesium non-sulphur containing phenate, or sulphur containing phenate (typically calcium non-sulphur containing phenate, or sulphur containing phenate). When present the non-sulphur containing phenate, or sulphur containing phenate may be present at 0.1 to 10 wt %, or 0.5 to 8 wt %, or 1 to 6 wt %, or 2.5 to 5.5 wt % of the lubricating composition.

In one embodiment the lubricating composition may be free of an overbased phenate, and in a different embodiment the lubricating composition may be free of a non-overbased phenate. In another embodiment the lubricating composition may be free of a phenate detergent.

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e., tetrapropenylphenol (i.e., p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP. In one embodiment, the lubricating composition comprises a phenate detergent prepared from PDDP wherein the phenate detergent contains less than 1.0 weight percent unreacted PDDP, or less than 0.5 weight percent unreacted PDDP, or substantially free of PDDP.

In one embodiment the lubricating composition further comprises a salicylate detergent that may be neutral or overbased. The salicylates and known in the art. The salicylate detergent may have a TBN of 50 to 400, or 150 to 350, and a metal ratio of 0.5 to 10, or 0.6 to 2. Suitable salicylate detergents included alkylated salicylic acid, or alkylsalicylic acid. Alkylsalicylic acid may be prepared by alkylation of salicylic acid or by carbonylation of alkylphenol. When alkylsalicylic acid is prepared from alkylphenol, the alkylphenol is selected in a similar manner as the phenates described above. In one embodiment, alkylsalicylate of the invention include those alkylated with oligomers of propylene, i.e., tetrapropenylphenol (i.e., p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises a salicylate detergent prepared from PDDP wherein the phenate detergent contains less than 1.0 weight percent unreacted PDDP, or less than 0.5 weight percent unreacted PDDP, or substantially free of PDDP.

When present the salicylate may be present at 0.01 to 10 wt %, or 0.1 to 6 wt %, or 0.2 to 5 wt %, 0.5 to 4 wt %, or 1 to 3 wt % of the lubricating composition.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt. U.S. Pat. No. 3,929,650 discloses borated complexes and their preparation.

The amount of the detergent component in a completely formulated lubricant, if present, will typically be 0.01 to 15 percent by weight, 0.5 to 10 percent by weight, such as 1 to 7 percent by weight, or 1.2 to 4 percent by weight. Its concentration in a concentrate will be correspondingly increased, to, e.g., 5 to 65 weight percent.

Anti-Wear Agents—Phosphorus Containing Materials

The compositions of the present invention can also include at least one phosphorus acid, phosphorus acid salt, phosphorus acid ester or derivative thereof including sulfur-containing analogs. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

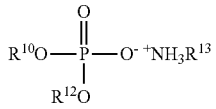

where $R^{10}$, $R^{12}$, $R^{13}$ are alkyl or hydrocarbyl groups or one of $R^{12}$ and $R^{12}$ can be H. The materials can be a 1:1 mixture of dialkyl and monoalkyl phosphoric acid esters. Compounds of this type are described in U.S. Pat. No. 5,354,484.

Other phosphorus-containing materials that may be present include dialkylphosphites (sometimes referred to as dialkyl hydrogen phosphonates) such as dibutyl phosphite. Yet other phosphorus materials include phosphorylated hydroxy-substituted tri-esters of phosphorothioic acids and amine salts thereof, as well as sulfur-free hydroxy-substituted di-esters of phosphoric acid, sulfur-free phosphorylated hydroxy-substituted di- or tri-esters of phosphoric acid, and amine salts thereof. These materials are further described in U.S. patent application US 2008-0182770.

The composition of the invention can include metal salts of a phosphorus acid such as metal salts of the formula

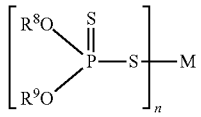

wherein $R^8$ and $R^9$ are independently hydrocarbyl groups containing 3 to 30 carbon atoms are readily obtainable by the reaction of phosphorus pentasulfide ($P_2S_3$) and an alcohol or phenol to form an O,O-dihydrocarbyl phosphorodithioic acid corresponding to the formula

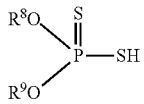

The metal M, having a valence n, generally is aluminum, lead, tin, manganese, cobalt, nickel, zinc, or copper, and in certain embodiments, zinc. The basic metal compound can thus be zinc oxide, and the resulting metal compound is represented by the formula

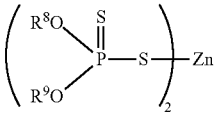

The $R^8$ and $R^9$ groups are independently hydrocarbyl groups that may be free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohols which react to provide the $R^8$ and $R^9$ groups can be one or more primary alcohols, one or more secondary alcohols, a mixture of secondary alcohol and primary alcohol. A mixture of two secondary alcohols such as isopropanol and 4-methyl-2-pentanol is often desirable.

Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, will typically be 0.01 to 6 percent by weight, 0.1 to 5 percent by weight, such as 0.3 to 2 percent by weight, or 0.5 to 1.5 percent by weight. Its concentration in a concentrate will be correspondingly increased, to, e.g., 5 to 60 weight percent.

Friction Modifiers

Another component that may be used in the composition used in the present technology is a friction modifier. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of friction modifiers that may be used may include: fatty phosphites; borated alkoxylated fatty amines; fatty acid amides; metal salts of fatty acids; fatty epoxides; sulfurized olefins; borated fatty epoxides; fatty imidazolines; fatty amines; condensation products of carboxylic acids and polyalkylene-polyamines; glycerol esters; metal salts of alkyl salicylates; borated glycerol esters; amine salts of alkylphosphoric acids; alkoxylated fatty amines; ethoxylated alcohols; oxazolines; imidazolines; hydroxyalkyl amides; polyhydroxy tertiary amines; and mixtures of two or more thereof.

Representatives of each of these types of friction modifiers are known and are commercially available. For instance, fatty phosphites may be generally of the formula $(RO)_2PHO$ or (RO)(HO)PHO where R may be an alkyl or alkenyl group of sufficient length to impart oil solubility. Suitable phosphites are available commercially and may be synthesized as described in U.S. Pat. No. 4,752,416.

Borated fatty epoxides that may be used are disclosed in Canadian Patent No. 1,188,704. These oil-soluble boron-containing compositions may be prepared by reacting a boron source such as boric acid or boron trioxide with a fatty epoxide which may contain at least 8 carbon atoms. Non-borated fatty epoxides may also be useful as supplemental friction modifiers.

Borated amines that may be used are disclosed in U.S. Pat. No. 4,622,158. Borated amine friction modifiers (including borated alkoxylated fatty amines) may be prepared by the reaction of a boron compounds, as described above, with the corresponding amines, including simple fatty amines and hydroxy containing tertiary amines. The amines useful for preparing the borated amines may include commercial alkoxylated fatty amines known by the trademark "ETHOMEEN" and available from Akzo Nobel, such as bis[2-hydroxyethyl]-cocoamine, polyoxyethylene[10]cocoamine, bis[2-hydroxyethyl]-soyamine, bis[2-hydroxyethyl]-tallowamine, polyoxyethylene-[5]tallowamine, bis[2-hydroxyethyl]oleylamine, bis[2-hydroxyethyl] octadecylamine, and polyoxyethylene[15]-octadecylamine. Such amines are described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used in preparing the above glycerol esters; they may also be used in preparing their metal salts, amides, and imidazolines, any of which may also be used as friction modifiers. The fatty acids may contain 6 to 24 carbon atoms, or 8 to 18 carbon atoms. A useful acid may be oleic acid.

The amides of fatty acids may be those prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines may be imidazolines or amides.

The fatty acid may also be present as its metal salt, e.g., a zinc salt. These zinc salts may be acidic, neutral, or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Suitable carboxylic acids include those of the formula RCOOH where R is an aliphatic or alicyclic hydrocarbon radical. Among these are those wherein R is a fatty group, e.g., stearyl, oleyl, linoleyl, or palmityl. Also suitable are the zinc salts wherein zinc is present in a stoichiometric excess over the amount needed to prepare a neutral salt. Salts wherein the zinc is present from 1.1 to 1.8 times the stoichiometric amount, e.g., 1.3 to 1.6 times the stoichiometric amount of zinc, may be used. These zinc carboxylates are known in the art and are described in U.S. Pat. No. 3,367,869. Metal salts may also include calcium salts. Examples may include overbased calcium salts.

Sulfurized olefins are also well known commercial materials used as friction modifiers. A suitable sulfurized olefin is one which is prepared in accordance with the detailed teachings of U.S. Pat. Nos. 4,957,651 and 4,959,168. Described therein is a cosulfurized mixture of 2 or more reactants selected from the group consisting of at least one fatty acid ester of a polyhydric alcohol, at least one fatty acid, at least one olefin, and at least one fatty acid ester of a monohydric alcohol. The olefin component may be an aliphatic olefin, which usually will contain 4 to 40 carbon atoms. Mixtures of these olefins are commercially available. The sulfurizing agents useful in the process of the present invention include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16) alkyl-substituted salicylic acids.

Amine salts of alkylphosphoric acids include salts of oleyl and other long chain esters of phosphoric acid, with amines such as tertiary-aliphatic primary amines, sold under the tradename Primene™.

Eighty-five percent phosphoric acid is a suitable material for addition to the fully-formulated compositions to increase frictional properties and can be included at a level of 0.01-0.3 weight percent based on the weight of the composition, such as 0.03 to 0.2 or to 0.1 percent.

The amount of friction modifier, if it is present, may be 0.01 to 10 or 5 percent by weight of the lubricating composition, 0.1 to 2.5 percent by weight of the lubricating composition, such as 0.1 to 2.0, 0.2 to 1.75, 0.3 to 1.5 or 0.4 to 1 percent. In some embodiments, however, the amount of friction modifier is present at less than 0.2 percent or less than 0.1 percent by weight, for example, 0.01 to 0.1 percent.

Viscosity Modifiers

Other additives may be present in the lubricants of the disclosed technology. One component frequently used is a viscosity modifier. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropylamine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series from Afton, and LZ 7702™, LZ 7727™, LZ 7725™ and LZ 7720C™ from Lubrizol); olefingraft-polymethacrylate polymers (such as Viscoplex™ 2-500 and 2-600 from RohMax); and hydrogenated polyisoprene star polymers (such as Shellvis™ 200 and 260, from Shell). Also included are Asteric™ polymers from Lubrizol (methacrylate polymers with radial or star architecture). Viscosity modifiers that may be used are described in U.S. Pat. Nos. 5,157,088, 5,256,752 and 5,395,539. The VMs and/or DVMs may be used in the functional fluid at a concentration of up to 20% or 60% or 70% by weight. Concentrations of 0.1 to 12%, 0.1 to 4%, 0.2 to 3%, 1 to 12% or 3 to 10% by weight may be used.

Antioxidants

Other materials can optionally be included in the compositions of the present technology, provided that they are not incompatible with the afore-mentioned required components or specifications. Such materials include antioxidants (that is, oxidation inhibitors), including hindered phenolic antioxidants, secondary aromatic amine antioxidants such as dinonyldiphenylamine as well as such well-known variants as monononyldiphenylamine and diphenylamines with other alkyl substituents such as mono- or di-ocyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins.

The amount of anti-oxidant, if it is present, may be 0.01 to 5 or 3 percent by weight of the lubricating composition, or 0.3 to 1.2 percent by weight of the lubricating composition, such as 0.5 to 1.2, 0.6 to 1.0 or 0.7 to 0.9 or 0.15 to 4.5, or 0.2 to 4, percent by weight.

Other Additives

The compositions of the present invention may also include, or exclude, conventional amounts of other components which are commonly found in lubricating compositions.

Also included may be corrosion inhibitors or metal deactivators such as tolyl triazole and dimercaptothiadiazole and oil-soluble derivatives of such materials. These include derivatives of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine.

Other optional components include additional seal swell additives, such as isodecyl sulfolane or phthalate esters, which are designed to keep seals pliable.

Other materials are anti-wear agents such as tridecyl adipate, and various longchain derivatives of hydroxy carboxylic acids, such as tartrates, tartramides, tartrimides, and citrates as described in US Application 2006-0183647. These optional materials are known to those skilled in the art and are generally commercially available. Yet other commercially available anti-wear gents include dimercaptothiadizoles and their derivatives, which are described in greater detail in published European Patent Application 761,805.

Also included can be known materials such as, demulsifiers, dyes, fluidizing agents, odor masking agents, and antifoam agents. Demulsifiers include trialkyl phosphates, and various polymers and copolymers of ethylene glycol, ethylene oxide, propylene oxide, or mixtures thereof different from the non-hydroxy terminated acylated polyether of the disclosed technology. Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. Foam inhibitors that may be useful in the compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Also included may be extreme pressure agents, chlorinated aliphatic hydrocarbons; boron-containing compounds including organic borate esters and organic borate salts; and molybdenum compounds. Extreme Pressure (EP) agents include sulphur- and chlorosulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405). The polysulphides are generally characterized as having sulphur-sulphur linkages. Typically the linkages have about 2 to about 8 sulphur atoms, or about 2 to about 6 sulphur atoms, or 2 to about 4 sulphur atoms. In one embodiment the polysulphide contains at least about 20 wt %, or at least about 30 wt % of the polysulphide molecules contain three or more sulphur atoms. In one embodiment at least about 50 wt % of the polysulphide molecules are a mixture of tri- or tetra-sulphides. In other embodiments at least about 55 wt %, or at least about 60 wt % of the polysulphide molecules are a mixture of tri- or tetra-sulphides. In one embodiment up to about 90 wt % of the polysulphide molecules are a mixture of tri- or tetra-sulphides. In other embodiments up to about 80 wt % of the polysulphide molecules are a mixture of tri- or tetra-sulphides. The polysulphide in other embodiments contain about 0 wt % to about 20 wt %, or about 0.1 to about 10 wt % of a penta- or higher polysulphide. In one embodiment the polysulphide contains less than about 30 wt % or less than about 40 wt % of a disulphide in the polysulphide. The polysulphide typically provides about 0.5 to about 5 wt %, or about 1 to about 3 wt %, of sulphur to the lubricating composition.

Pour point depressants are a particularly useful type of additive, often included in the lubricating oils described herein, usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Pour point depressants that may be useful in the compositions of the disclosed technology also include polyalphaolefins, esters of maleic anhydride-styrene copolymers, polyacrylates or polyacrylamides.

Additional antioxidants can also be included, typically of the aromatic amine or hindered phenol type. These and other additives which may be used in combination with the present invention are described in greater detail in U.S. Pat. No. 4,582,618 (column 14, line 52 through column 17, line 16, inclusive).

The compound of formula (I) may be suitable for use in lubricating compositions such as an engine lubricant for an internal combustion engine or a lubricating composition for a driveline device such as a gear oil, axle oil, drive shaft oil, traction oil, manual transmission oils, automatic transmission oils, off-highway oils (such as tractor oils) or as an automotive gear oil (AGO).

Lubricating Composition for an Engine

In one embodiment the compound of the invention is used as seal swell agent in a lubricating composition for an internal combustion engine, i.e., a crankcase lubricant.

The internal combustion engine may comprise a steel surface, for example, on a cylinder bore, a cylinder block or a piston ring. The internal combustion engine may be a motorcycle, a passenger car, a heavy duty diesel internal combustion engine or a 2-stroke or 4-stroke marine diesel engine.

The lubricating composition can have at least one of: (i) a sulphur content of up to and including 0.5 wt %, less than 0.5 wt % or from 0.1 to 0.4 wt %; (ii) a phosphorus content of up to and including 0.15 wt %, less than 1.5 wt % or from 0.01 or 0.03 to 0.08, 0.10 or 0.12 wt %; and (iii) a sulphated ash content of 0.5 wt % to 1.1 or 1.5 wt % of the lubricating composition.

A typical crankcase lubricant may contain an oil of lubricating viscosity, for example a Group I, Group II, Group III mineral oil or combinations thereof, with a kinematic viscosity of 3.6 to 7.5 $mm^2/s$, or 3.8 to 5.6 $mm^2/s$, or 4.0 to 4.8 $mm^2/s$.

In addition to the compound of formula (I), the engine lubricating composition may further include other additives, for example, selected from those described above, in the amounts indicated above. In one embodiment the disclosed technology provides a lubricating composition further comprising at least one of an overbased detergent (including, for example, overbased sulphonates and phenates), an antiwear agent, an antioxidant (including, for example, phenolic and aminic antioxidants), a friction modifier, a corrosion inhibitor, a dispersant (typically a polyisobutylene succinimide dispersant), a dispersant viscosity modifier, a viscosity modifier (typically an olefin copolymer such as an ethylene-propylene copolymer), or mixtures thereof. In one embodiment the disclosed technology provides a lubricating composition comprising a compound of formula (I) and further comprising an overbased detergent, an antiwear agent, an antioxidant, a friction modifier and a corrosion inhibitor.

Suitable overbased detergents are described in the "Detergents" section above. The engine oil lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

In one embodiment an engine lubricating composition may be a lubricating composition further comprising at least one antiwear agent. Suitable antiwear agents are described in the "Anti-wear Agents" section above and include titanium compounds, tartaric acid derivatives such as tartrate esters, amides or tartrimides, malic acid derivatives, citric acid derivatives, glycolic acid derivatives, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides. The antiwear agent many be a phosphorus-containing antiwear agent. Typically the phosphorus-containing antiwear agent may be a zinc dialkyldithiophosphate, a phosphite, a phosphate, a phosphonate, and an ammonium phosphate salt, or mixtures thereof. Zinc dialkyldithiophosphates are known in the art. The antiwear agent may be present at 0 wt % to 6 or 3 wt %, or 0.1 wt % to 1.5 wt %, or 0.5 wt % to 0.9 wt % of the lubricating composition.

The composition can comprise a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof. In one embodiment the lubricant composition includes an antioxidant, or mixtures thereof. The antioxidant may be present at 0 wt % to 10 wt %, or 0.1 wt % to 6 wt %, or 0.5 wt % to 5 wt %, or 0.5 wt % to 3 wt %, or 0.3 wt % to 1.5 wt % of the lubricant composition.

Suitable friction modifiers are described above under "Friction Modifiers". Engine oil lubricants (i.e., crankcase lubricants), often include friction modifying additives that reduce dynamic friction between two surfaces, typically steel surfaces; this is carried out largely to improve fuel economy. Additives of this type are often referred to as "fatty" and include fatty acids, esters, amides, imides, amines, and combinations thereof. Examples of suitable friction reducing additives include glycerol mono-oleate, oleyl amide, ethoxylated tallow amine, oleyl tartrimide, fatty alkyl esters of tartaric acid, oleyl malimide, fatty alkyl esters of malic acid and combinations thereof. Alternatively, molybdenum additives may be used to reduce friction and improve fuel economy. Examples of molybdenum additives include dinuclear molybdenum dithiocarbamate complexes, for example Sakuralube™ 525 available from Adeka corp.; trinuclear molybdenum dithiocarbamate complexes; molybdenum amines, for example Sakuralube™ 710 available from Adeka corp.; mononuclear molybdenum dithiocarbamate complexes; molybdenum ester/amide additves, for example Molyvan® 855 available from Vanderbilt Chemicals, LLC; molybdated dispersants; and combinations thereof.

Useful corrosion inhibitors for an engine lubricating composition are described above and include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, HighPerformance Polyglycols for Demanding Applications."

Suitable dispersants are described above under "Dispersants". In one embodiment, the composition comprises a succinimide dispersant and this can be a borated or non-borated succinimide dispersant.

Suitable viscosity modifiers and dispersant viscosity modifiers are described above under "Viscosity modifiers". In one embodiment the lubricating composition of the disclosed technology further comprises a dispersant viscosity modifier. The dispersant viscosity modifier may be present at 0 to 10 wt %, or 0 wt % to 5 wt %, or 0 wt % to 4 wt %, or 0.05 wt % to 2 wt %, or 0.2 wt % to 1.2 wt % of the lubricating composition.

The engine lubricating composition may also comprise a foam inhibitor, pour point depressant, demulsifier, metal deactivator or additional seal swell agent or mixtures thereof. Suitable candidates are described above under "other additives".

In one embodiment the lubricating composition comprises a compound of the invention in an amount 0.01 to 1.5 weight percent of the composition; at least one ashless dispersant in an amount 0.5 to 6 weight percent; at least one metal containing overbased detergent in an amount 0.5 to 3 weight percent of the composition; at least one zinc-free anti-wear agent which is a phosphorus-containing compound, a sulfur- and phosphorus-free organic anti-wear agent, or mixtures thereof in an amount 0.01 to 2 weight percent of the composition; at least one ashless antioxidant (selected from hindered phenols and/or diarylamines) in an amount 0.2 to 5 weight percent of the composition; a polymeric viscosity index improver in an amount 0.0 to 6 weight percent of the composition and, optionally, one or more additional additives selected from corrosion inhibitors, foam inhibitors, additional seal swell agents, and pourpoint depressants.

An engine lubricating composition in different embodiments may have a composition as disclosed in the following table:

TABLE 2

| | Embodiments (wt %) | | |
|---|---|---|---|
| Additive | A | B | C |
| Compound of formula (I) | 0.05 to 2 | 0.1 to 1.2 | 0.25 to 0.75 |
| Ashless Dispersant | 0.05 to 10 | 0.75 to 6 | 1.5 to 5 |
| Antioxidant | 0.05 to 10 | 0.2 to 3 | 0.5 to 2 |
| Dispersant Viscosity Modifier | 0 or 0.05 to 5 | 0 or 0.05 to 4 | 0.05 to 2 |
| Overbased Detergent | 0 or 0.05 to 15 | 0.1 to 6 | 0.5 to 3 |
| Antiwear Agent | 0 or 0.05 to 6 | 0.05 to 4 | 0.1 to 2 |
| Friction Modifier | 0 or 0.05 to 10 | 0.5 to 8 | 1 to 6 |
| Viscosity Modifier | 0 or 0.05 to 10 | 0 or 0.05 to 8 | 0 or 0.05 to 6 |
| Any Other Performance Additive | 0.05 to 2 | 0.1 to 1.2 | 0.25 to 0.75 |
| Oil of Lubricating Viscosity | Balance to 100% | Balance to 100% | Balance to 100% |

The compositions of the present invention exhibit several advantages. Engine seals, for example, particularly in older vehicles, have a tendency to dry out and shrink over time, and a powerful seal swell agent may effectively re-swell and soften the dried seals, regenerating them so they will perform their originally intended function. Seal swell agents are useful, for example, in preventing deterioration of both Viton™ and nitrile rubber seals, as evaluated in the MTU (Michigan Technical University) seal screen test in a passenger car motor oil GF5 formulation, in which all candidates are evaluated initially at 1% concentration in the blend as a typical treat level at which seal swell performance is evaluated.

Lubricating Composition for a Driveline Device

In another embodiment, the compound of the invention is used as seal swell agent in a lubricating composition suitable for lubricating a driveline device such as a manual transmission, automatic transmission, axle, gear or drive shaft. The driveline device may be on an off highway vehicle such as a farm tractor. Off highway vehicles operate under harsher conditions than on-highway vehicles.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm. The phosphorus content may be 400 to 2000 ppm, or 400 to 1500 ppm, or 500 to 1400 ppm, or 400 to 900 ppm, or 500 to 850 ppm or 525 to 800 ppm.

In addition to the compound of formula (I) as described herein, the driveline lubricating composition may include further additives, for example, selected from those described above, in the amounts indicated above. In one embodiment, the disclosed technology provides a lubricating composition further comprising at least one of an antiwear agent, a viscosity modifier (typically a polymethacrylate having linear, comb or star architecture), an overbased detergent (including, for example, overbased sulphonates, phenates and salicylates), a dispersant, a friction modifier, an antioxidant (including, for example, phenolic and aminic antioxidants), a dispersant viscosity modifier, and mixtures thereof. In one embodiment, the disclosed technology provides a lubricating composition comprising a compound of formula (I), an oil of lubricating viscosity and further comprising an antiwear agent, a viscosity modifier, and at least one of a dispersant and an overbased detergent. In this embodiment, the lubricating composition may further comprise a friction modifier.

Suitable antiwear agents are described above under "Antiwear agents" and include an oil soluble phosphorus amine salt antiwear agent such as an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination. In one embodiment the oil soluble phosphorus amine salt includes partial amine salt-partial metal salt compounds or mixtures thereof. In one embodiment the phosphorus compound further includes a sulphur atom in the molecule. Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components). The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Suitable viscosity modifiers and dispersant viscosity modifiers are described above under "Viscosity modifiers". Viscosity modifiers are usually polymers, including polyisobutenes, polymethacrylic acid esters, diene polymers, polyalkylstyrenes, esterified styrene-maleic anhydride copolymers, alkenylarene-conjugated diene copolymers, and polyolefins. Multifunctional viscosity improvers, which also have dispersant and/or anti-oxidancy properties are known and may optionally be used. The amount of viscosity modifier may range from 0.1 to 70 wt %, or 1 to 50 wt %, or 2 to 40 wt %. In an automotive gear oil, for example, the viscosity modifier and/or dispersant viscosity modifier may be present in the lubricating composition in an amount of 5 to 60 wt %, or 5 to 50 wt %, or 5 to 40 wt %, or 5 to 30 wt % or 5-20 wt %. Typically the viscosity modifier may be a polymethacrylate, or mixtures thereof.

A driveline device lubricating composition may contain a detergent such as described above under "Detergents". A driveline device lubricating composition may contain an overbased detergent that may or may not be borated. For example the lubricating composition may contain a borated overbased calcium or magnesium sulphonate detergent, or mixtures thereof. Suitable overbased detergents are described in the "Detergents" section above. The lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. In an automotive gear oil, for example, the detergent may be present in the lubricating composition in an amount of 0.05 to 1 wt %, or 0.1 to 0.9 wt %. In a manual transmission fluid, for example, the detergent may be present in the lubricating composition in an amount of at least 0.1%, e.g., 0.14 to 4 wt %, or 0.2 to 3.5 wt %, or 0.5 to 3 wt %, or 1 to 2 wt %, or 0.5 to 4 wt %, or 0.6 to 3.5 wt % or, 1 to 3 wt %, or at least 1 wt 5, e.g., 1.5 to 2.8 wt %. In one embodiment, the composition can comprise one or more detergents containing calcium. In this embodiment, the total amount of calcium provided by the detergent(s) to the lubricant may be 0.03 to 1 wt %, or 0.1 to 0.6 wt %, or 0.2 to 0.5 wt %.

Suitable dispersants are described above under "Dispersants". The dispersant may be a succinimide dispersant. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150. In one embodiment the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent. In an automotive gear oil, or in a manual transmission fluid, for example, the dispersant may be present in the lubricating composition in an amount of at least 0.1 wt %, or at least 0.3 wt %, or at least 0.5 wt % and at most 5 wt % or 4 wt % or 3 wt % of 2 wt %.

Suitable friction modifiers are described above under "Friction Modifiers". Suitable friction modifiers include:

an amide, or thio amide, represented by the formula $R^3C(X)NR^1R^2$ where X is O or S and $R^1$ and $R^2$ are each independently hydrocarbyl groups of at least 6 (or 8 to 24 or 10 to 18) carbon atoms and $R^3$ is a hydroxyalkyl group of 1 to 6 carbon atoms or a group formed by the condensation of the hydroxyalkyl group, through a hydroxyl group thereof, with an acylating agent;

a tertiary amine being represented by the formula $R^4R^5NR^6$ wherein $R^4$ and $R^5$ are each independently alkyl groups of at least 6 carbon atoms and $R^6$ is a polyhydroxy-containing alkyl group or a polyhydroxy-containing alkoxy-alkyl group;

N-substituted oxalic acid bisamide or amide-ester containing at least two hydrocarbyl groups of about 12 to about 22 (or 12 to 20 or 12 to 18 or 12 to 16 or 12 to 14 or 14 to 20 or 14 to 18 or 14 to 16) carbon atoms carbon atoms;

fatty imidazolines such as the cyclic condensation product of an acid with a diamine or polyamine such as a polyethylenepolyamine and, in one embodiment, the friction modifier may be the condensation product of a C8 to C24 fatty acid with a polyalkylene polyamine, for example, the product of isostearic acid with tetra-ethylene-pentamine (the condensation products of carboxylic acids and poly-alkyleneamines may be imidazolines or amides);

friction modifiers consisting of the reaction product of a carboxylic acid or a reactive equivalent thereof with an aminoalcohol, selected from the group consisting of tris-hydroxymethylaminomethane, 2-amino-2-ethyl-1,3-propanediol, 3-amino-1-propanol, 2-amino-1-propanol, 1-amino-2-propanol, 2-amino-2-methyl-1-propanol, 4-amino-1-butanol, 5-amino-1-pentanol, 2-amino-1-pentanol, 2-amino-1,2-propanediol, 2-amino-1,3-propanediol, 2-amino-2-methyl-1,3-propanediol, N-(2-hydroxyethyl)ethylenediamine, N,N-bis(2-hydroxyethyl)ethylenediamine, 1,3-diamino-2-hydroxypropane, N,N'-bis-(2-hydroxyethyl) ethylenediamine, and 1-aminopropyl-3-diisopropanol amine, wherein the friction modifier contains at least two branched chain alkyl groups, each containing at least 6 carbon atoms;

sulfurized olefins, such as sulfurized vegetable oil, lard oil or C16-18 olefins;

borate esters from the reaction product of boron trioxide and an epoxide having at least 8 carbon atoms, or 10 to 20 carbon atoms or comprises a straight chain hydrocarbyl group of 14 carbon atoms (see U.S. Pat. No. 4,584,115) and borate esters formed by the reaction of an alcohol and boric acid, wherein the alcohol is typically branched, & of C6 to C10, or C8 to C10 or C8;

ethoxylated amines;

phosphorus containing compounds such as phosphoric acid as friction stabilizer and di-(fatty) alkyl phosphites; and metal salts of fatty acids. Friction modifiers (other than (a) a borated phospholipid, and (b) an amine salt of a phosphoric acid ester) also include fatty phosphonate esters, reaction products from fatty carboxylic acids reacted with guanidine, aminoguanidine, urea or thiourea, and salts thereof, fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines. In an automotive or axle gear oil, for example, the friction modifier may be present in the lubricating composition in an amount of 1 to 5 wt %, or 2 to 4 wt %, or 2 to 3.5 wt %.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof.

The driveline lubricating composition may also comprise a foam inhibitor, pour point depressant, corrosion inhibitor, demulsifier, metal deactivator or additional seal swell agent or mixtures thereof. Suitable candidates are described above under "other additives". Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition in different embodiments may have a composition as disclosed in the following table:

TABLE 3

| | Embodiments (wt %) | | | |
|---|---|---|---|---|
| Additive | A | B | C | D |
| Compound of formula (I) | 0.01 or 0.05 to 1.5 | 0.01 or 0.05 to 1.5 | 0.1 to 1, or 0.05 to 1.5 | 0.2 to 0.5, or 0.05 to 1.5 |
| Dispersant | 1 to 4 | 0.1 to 10, 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 3, 0.025 to 2 | 0.5 to 6 | 0.01 to 2 |
| Antioxidant | 0 to 5 | 0.01 to 10 or 2 | 0 to 3 | 0 to 2 |
| Antiwear Agent | 0.5 to 5 | 0.01 to 15 | 0.5 to 3 | 0.01 to 3 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 or 10 | 0 to 6 | 0 to 10 |
| Oil of Lubricating Viscosity | Balance to 100% | Balance to 100% | Balance to 100 % | Balance to 100% |

Footnotes:

The viscosity modifier in the table above may also be considered as an alternative to an oil of lubricating viscosity.

Column A may be representative of an automotive or axle gear lubricant.

Column B may be representative of an automatic transmission lubricant.

Column C may be representative of an off-highway lubricant.

Column D may be representative of a manual transmission lubricant.

In one embodiment, the lubricating composition is an automatic transmission lubricant comprising: a compound of formula (I), dispersant in an amount of 0.1 to 10 wt %, a detergent in an amount of 0.025 to 3 wt % or when the detergent contains calcium, a detergent in an amount to contribute 130 to 600 ppm to the composition, a phosphorus containing compound in an amount of 0.01 to 0.3 wt %, an antiwear agent in an amount of 0.01 to 15 wt %, a viscosity modifier in an amount of 0 to 12 wt %, an antioxidant in an amount of 0 to 10 wt %, a corrosion inhibitor in an amount of 0.001 to 10 wt % and a friction modifier in an amount of 0.01 to 5 wt %. In one embodiment, the lubricating composition is an automatic transmission lubricant comprising: a compound of formula (I), a dispersant in an amount of 0.2 to 7 wt %, a detergent in an amount of 0.1 to 1 wt % or when the detergent contains calcium, a detergent in an amount to contribute 160 to 400 ppm to the composition, a phosphorus containing compound in an amount of 0.03 to 0.2 wt %, an antiwear agent in an amount of 0.05 to 10 wt %, a viscosity modifier in an amount of 0.1 to 10 wt %, an antioxidant in an amount of 0.01 to 5 wt %, a corrosion inhibitor in an amount of 0.005 to 5 wt % and a friction modifier in an amount of 0.01 to 4 wt %. In one embodiment, the lubricating composition is an automatic transmission lubricant comprising: a compound of formula (I), a dispersant in an amount of 0.3 to 6 wt %, a detergent in an amount of 0.1 to 8 wt % or when the detergent contains calcium, a detergent in an amount to contribute 0 to 250 ppm to the composition, a phosphorus containing compound in an amount of 0.03 to 0.1 wt %, an antiwear agent in an amount of 0.075 to 5 wt %, a viscosity modifier in an amount of 1 to 8 wt %, an antioxidant in an amount of 0.05 to 3 wt %, a corrosion inhibitor in an amount of 0.01 to 3 wt % and a friction modifier in an amount of 0.25 to 3.5 wt %. In one embodiment, the lubricating composition is an automatic transmission lubricant comprising: a compound of formula (I), a dispersant in an amount of 1 to 5 wt %, a detergent containing calcium in an amount to contribute 1 to 200 ppm to the composition, an antiwear agent in an amount of 0.1 to 3 wt %, a viscosity modifier in an amount of 3 to 8 wt %, an antioxidant in an amount of 0.1 to 1.2 wt %, a corrosion inhibitor in an amount of 0.02 to 2 wt % and a friction modifier in an amount of 0.1 to 3 wt %. In one embodiment, the lubricating composition is an automatic transmission lubricant comprising: a compound of formula (I), a detergent containing calcium in an amount to contribute 10 to 150 ppm to the composition, an antioxidant in an amount of 0.2 to 1 wt % and a friction modifier in an amount of 0.5 to 2.5 wt %. In one embodiment, the lubricating composition is an automatic transmission lubricant comprising: a compound of formula (I), a detergent containing calcium in an amount to contribute 20 to 100 ppm to the composition, an antioxidant in an amount of 0.3 to 1 wt % and a friction modifier in an amount of 1 to 2.5 wt %.

INDUSTRIAL APPLICATION

The compound of formula (I) may be useful in providing seal swelling performance in a grease, or in a lubricating composition for industrial gears or an industrial gearbox, a turbine system, a hydraulic system, a circulating oil system, a gas compressor or a refrigeration system.

The lubricant composition may be in the form of a concentrate and/or a fully formulated lubricant. If the lubricant composition of the invention (comprising the additives disclosed herein) is in the form of a concentrate (which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

The lubricant composition of the disclosed technology may further include other additives. In one embodiment the invention provides a lubricant composition further comprising at least one of a dispersant, an anti-wear agent, a dispersant viscosity modifier, a friction modifier, a viscosity modifier, an antioxidant, a detergent including an overbased detergent, a foam inhibitor, a demulsifier, a pour point depressant or mixtures thereof. In one embodiment the disclosed technology provides a lubricant composition further comprising at least one of a polyisobutylene succinimide dispersant, an anti-wear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates, phenates, and salicylates), or mixtures thereof.

Grease

In one embodiment the lubricant is a grease. The grease may have a composition comprising an oil of lubricating viscosity, a grease thickener, and an additive package. The additive package comprises the seal swell agent of the invention (the compound of formula (I)) and, optionally, other performance additives.

The grease thickening agent, or thickener, may include a metal salt of one or more carboxylic acids that is known in the art of grease formulation. Often the metal is an alkali metal, alkaline earth metal, aluminum, or mixtures thereof. Examples of suitable metals include lithium, potassium, sodium, calcium, magnesium, barium, titanium, aluminum, and mixtures thereof. The metal may include lithium, calcium, aluminum, or mixtures thereof (typically lithium).

The carboxylic acid used in the thickener is often a fatty acid and may include a mono-hydroxycarboxylic acid, a di-hydroxycarboxylic acid, a poly-hydroxycarboxylic acid or mixtures thereof. The carboxylic acid may have 4 to 30, 8 to 27, 19 to 24 or 10 to 20 carbon atoms and may include derivatives thereof such as esters, half esters, salts, anhydrides, or mixtures thereof. A particularly useful hydroxy-substituted fatty acid is hydroxystearic acid, wherein one or more hydroxy groups are often located at positions 10-, 11-, 12-, 13- or 14-on the alkyl group. Suitable examples may include 10-hydroxystearic acid, 11-hydroxystearic acid, 12-hydroxystearic acid, 13-hydroxystearic acid, 14-hydroxystearic acid and mixtures thereof. In one embodiment the hydroxy-substituted fatty acid is 12-hydroxystearic acid. Examples of other suitable fatty acids include capric acid, palmitic acid, stearic acid, oleic acid, behenic acid, and mixtures thereof.

In one embodiment the carboxylic acid thickener is supplemented with a dicarboxylic acid, a polycarboxylic acid, or mixtures thereof. Suitable examples include hexanedioic acid (adipic), iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid and mixtures thereof. The di-carboxylic acid and poly-carboxylic acid tend to be more expensive than mono-carboxylic acid and as a consequence, most industrial processes using mixtures typically use a molar ratio of dicarboxylic and/or polycarboxylic acid to monocarboxylic acid in the range 1:10 to 1:2, including 1:5, 1:4, 1:3, or 1:2 as possible values or upper or lower limits. The actual ratio of acids used depends on the desired properties of the grease for the actual application. In one embodiment the dicarboxylic acid thickener is nonanedioic acid (azelaic acid) and in another decanedioic acid (sebacic acid), or mixtures thereof.

The grease thickener may include simple metal soap grease thickeners, mixed alkali soaps, complex soaps, non-soap grease thickeners, metal salts of such acid-functionalized oils, polyurea and diurea grease thickeners, calcium sulfonate grease thickeners or mixtures thereof.

The grease thickener may also include or be used with other known polymer thickening agents such polytetrafluoroethylene (commonly known as PTFE), styrene-butadiene rubber, styrene-isoprene polymers, olefin polymers such as polyethylene or polypropylene or olefin co-polymers such as ethylene-propylene or mixtures thereof.

In one embodiment the thickener may also include or be used with other known thickening agents such as inorganic powders including clay, organo-clays, bentonite, montmorillonite, fumed and acid modified silicas, calcium carbonate as calcite, carbon black, pigments, copper phthalocyanine or mixtures thereof.

The grease may also be a sulfonate grease. Sulfonate greases are disclosed in more detail in U.S. Pat. No. 5,308,514. The calcium sulfonate grease may be prepared from overbasing the a neutral calcium sulfonate such that the calcium hydroxide is carbonated to form amorphous calcium carbonate and subsequently converted into either calcite, or vaterite or mixtures thereof, but typically calcite.

The grease thickener may be a urea derivative such as a polyurea or a diurea. Polyurea grease may include tri-urea, tetra-urea or higher homologues, or mixtures thereof. The urea derivatives may include urea-urethane compounds and the urethane compounds, diurea compounds, triurea compounds, tetraurea compounds, polyurea compounds, urea-urethane compounds, diurethane compounds and mixtures thereof. The urea derivative may for instance be a diurea compound such as, urea-urethane compounds, diurethane compounds or mixtures thereof. A more detailed description of urea compounds of this type is disclosed in U.S. Pat. No. 5,512,188 column 2, line 24 to column 23, line 36.

In one embodiment the grease thickener may be polyurea or diurea. The grease thickener may be a lithium soap or lithium complex thickener. The grease thickener may be an aluminum soap, calcium soap, aluminum complex or calcium complex thickener.

The amount of grease thickener present in the grease composition includes those in the range from 1 wt % to 50 wt %, 1 wt % to 45 wt %, or 2 wt % to 40 wt %, or 3 wt % to 20 or 25 wt % of the grease composition.

The lubricating grease composition comprises an oil of lubricating viscosity as is described above. A lubricating grease composition may be prepared by adding a compound of formula (I) to an oil of lubricating viscosity, a grease thickener, optionally in the presence of other performance additives (as described herein below).

The additive package comprises the seal swell agent of the invention (the compound of formula (I) and, optionally, the other performance additives. The grease (also referred to herein as the grease composition or the lubricating grease composition) may comprise 0.01 or 0.05 to 2 wt %, or 0.01 or 0.05 to 1.5 wt %, 0.05 to 1 wt %, 0.15 to 1 wt %, 0.15 to 0.5 wt % of the compound of formula (I). The additive package may be present at 0.01 wt % to 10 wt %, or 0.01 wt % to 5 wt %, or 0.1 to 3 wt % of the grease composition.

The lubricating grease composition optionally comprises other performance additives. The other performance additives may include at least one of metal deactivators, viscosity modifiers, detergents, friction modifiers, anti-wear agents, corrosion inhibitors, dispersants, dispersant viscosity modifiers, extreme pressure agents, antioxidants, and mixtures thereof. Each of these other performance additives is described herein.

In one embodiment the lubricating grease composition optionally further includes at least one other performance additive, which can be chosen from a metal deactivator, a detergent, a dispersant, an anti-wear agent, an antioxidant, a corrosion inhibitor (typically a rust inhibitor), or mixtures thereof. Typically, a fully-formulated lubricating grease composition will contain one or more of these performance additives. The lubricating grease composition may contain a corrosion inhibitor or an anti-oxidant.

Anti-oxidants include diarylamine, alkylated diarylamines, hindered phenols, molybdenum compounds (such as molybdenum dithiocarbamates), hydroxyl thioethers, trimethyl polyquinoline (e.g., 1,2-dihydro-2,2,4-trimethylquinoline), or mixtures thereof. In one embodiment the lubricating grease composition includes an anti-oxidant, or mixtures thereof. The anti-oxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the grease composition.

The diarylamine and alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines. The alkylated diarylamine may be a tetra-alkylated diarylamine.

The hindered phenol anti-oxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol anti-oxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-ditert-butylphenol. In one embodiment the hindered phenol antioxidant may be an ester and may include, e.g., Irganox™ L-135 from BASF. A more detailed description of suitable ester-containing hindered phenol anti-oxidant chemistry is found in U.S. Pat. No. 6,559,105.

The dithiocarbamate anti-oxidant may be metal containing such as molybdenum or zinc dithiocarbamate or it may be "ashless," referring to the dithiocarbamate as containing no metal.

The 1,2-dihydro-2,2,4-trimethylquinoline anti-oxidant may be present as a unique molecule or oligomerized with up to 5 repeat units and known commercially as "Resin D", available from a number of suppliers.

In one embodiment the lubricating grease composition further includes a viscosity modifier. Viscosity modifiers are known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

Some polymers may also be described as dispersant viscosity modifiers (often referred to as DVM) because they exhibit dispersant properties. Polymers of this type include olefins, for example, ethylene propylene copolymers that have been functionalized by reaction with maleic anhydride and an amine. Another type of polymer that may be used is polymethacrylate functionalized with an amine (this type may also be made by incorporating a nitrogen containing co-monomer in a methacrylate polymerization). More detailed description of dispersant viscosity modifiers are disclosed in International Publication WO2006/015130 or U.S. Pat. Nos. 4,863,623; 6,107,257; 6,107,258; and 6,117,825.

Non-dispersant viscosity modifiers may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. A more detailed description of non-dispersant viscosity modifiers is disclosed in U.S. Pat. No. 6,300,288 to Scharf et al., issued Oct. 9, 2001.

The viscosity modifiers may be present at 0 wt % to 15 wt %, or 0 wt % to 10 wt %, or 0.05 wt % to 5 wt %, or 0.2 wt % to 2 wt % of the grease composition.

The lubricating grease composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

In one embodiment the invention provides a lubricating grease composition further comprising a metal-containing detergent, which may be overbased or neutral. The metal-containing detergent may be a calcium or magnesium detergent.

The metal-containing detergent may be chosen from non-sulfur containing phenates, sulfur containing phenates, sulfonates, salixarates, salicylates, and mixtures thereof, or borated equivalents thereof. The detergent may be borated with a borating agent such as boric acid such as a borated overbased calcium or magnesium sulfonate detergent, or mixtures thereof. The metal-containing detergent may also be an overbased detergent with total base number ranges from 30 to 500 mg KOH/g Equivalents (TBN as per ASTM D4739).

The detergent may be present at 0 wt % to 6 wt %, or 0.01 wt % to 4 wt %, or 0.05 wt % to 2 wt %, or 0.1 wt % to 2 wt % of the grease composition, for example, where the detergent is a metal-containing detergent other than an overbased metal-containing detergent, or alternatively 0 wt % to 2 wt %, or 0.05 wt % to 1.5 wt %, or 0.1 wt % to 1 wt % of the grease composition, for example, where the detergent is an overbased metal-containing detergent.

In one embodiment the lubricating grease disclosed herein may contain at least one friction modifier. The friction modifier may be present at 0 wt % to 6 wt %, or 0.01 wt % to 4 wt %, or 0.05 wt % to 2 wt %, or 0.1 wt % to 2 wt % of the grease composition.

As used herein the term "fatty alkyl" or "fatty" in relation to friction modifiers can mean a carbon chain having 10 to 22 carbon atoms, typically a straight carbon chain. Alternatively, the fatty alkyl may be a mono branched alkyl group, with branching typically at the β-position. Examples of mono-branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sulfurized molybdenum dialkyldithiophosphates, sulfurized molybdenum dithiocarbamates, or other oil soluble molybdenum complexes such as Molyvan® 855 (commercially available from R.T. Vanderbilt, Inc.) or Sakuralube® S-700 or Sakuralube® S-710 (commercially available from Adeka, Inc.). The oil soluble molybdenum complexes assist in lowering the friction, but may compromise seal compatibility.

In one embodiment the friction modifier may be an oil soluble molybdenum complex. The oil soluble molybdenum complex may include sulfurized molybdenum dithiocarbamate, sulfurized molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of Luvodor® MB or Luvodor® MBO (commercially available from Lehmann and Voss GmbH), The oil soluble molybdenum complexes may be present at 0 wt % to 5 wt %, or 0.1 wt % to 5 wt % or 1 to 3 wt % of the grease composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

The lubricating grease composition optionally further includes at least one anti-wear agent. Examples of suitable anti-wear agents include titanium compounds, oil soluble amine salts of phosphorus compounds, sulfurized olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis (S-alkyldithiocarbamyl) disulfides, and oil soluble phosphorus amine salts. In one embodiment the lubricating grease composition may further include metal dihydrocarbyldithiophosphates (such as zinc dialkyldithiophosphates). The optional anti-wear may be present at 0 wt % to 5 wt %, or 0.1 wt % to 5 wt % or 1 to 3 wt % of the grease composition.

The lubricating grease composition optionally also contains an extreme pressure agent, which may be a compound containing sulfur and/or phosphorus. Examples of extreme pressure agents include a polysulfide, a sulfurized olefin, a thiadiazole, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulfide molecules are a mixture of tri- or tetra-sulfides. In other embodiments at least 55 wt %, or at least 60 wt % of the polysulfide molecules are a mixture of tri- or tetra-sulfides.

The polysulfide may include a sulfurized organic polysulfide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides and synthetic sperm whale oil.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene or mixtures thereof. In one embodiment the polysulfide comprises a polyolefin derived from polymerizing by known techniques an olefin as described above. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present at 0 wt % to 5 wt %, 0.01 wt % to 4 wt %, 0.01 wt % to 3.5 wt %, 0.05 wt % to 3 wt %, and 0.1 wt % to 1.5 wt %, or 0.2 wt % to 1 wt % of the grease composition.

Solid additives in a particle or finely divided form may also be used in a lubricating grease at levels of 0% to 20% by weight. These include graphite, molybdenum disulfide, zinc oxide, boron nitride, or polytetrafluoroethylene. Mixtures of solid additives may also be used.

The lubricating grease composition may also contain a metal deactivator, which may comprise one or more derivatives of benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercaptothiadiazoles or mixtures thereof. The metal deactivator may also be described as corrosion inhibitors.

The benzotriazole compounds may include hydrocarbyl substitutions at one or more of the following ring positions 1- or 2- or 4- or 5- or 6- or 7-benzotriazoles. The hydrocarbyl groups may contain from 1 to 30 carbons, and in one embodiment from 1 to 15 carbons, and in one embodiment from 1 to 7 carbons. The metal deactivator may comprise 5-methylbenzotriazole.

The metal deactivator may be present in the lubricating grease composition at a concentration in the range up to 5 wt %, or 0.0002 to 2 wt %, or 0.001 to 1 wt %.

The grease composition may comprise a corrosion inhibitor, for example a rust inhibitor, The rust inhibitor may comprise one or more metal sulfonates such as calcium sulfonate or magnesium sulfonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from 8 to 24 carbon atoms with alcohols such as polyglycols.

The rust inhibitors may present in the lubricating grease composition at a concentration in the range up to 4 wt %, and in one embodiment in the range from 0.02 wt % to 2 wt %, and in one embodiment in the range from 0.05 wt % to 1 wt %.

The lubricating grease composition may comprise:

0.01 t % to 2 wt % of a compound of formula (I) as described herein;

1 wt % to 50 wt % of a grease thickener;

0 wt % to 5 wt % of an extreme pressure agent;

0 wt % to 10 wt % of other performance additives; and balance of an oil of lubricating viscosity.

The lubricating grease composition may comprise:

0.01 wt % to 2 wt % of a compound of formula (I) as described herein;

1 wt % to 20 wt % of a grease thickener;

0 wt % to 5 wt % of an extreme pressure agent;

0 wt % to 10 wt % of other performance additives; and balance of an oil of lubricating viscosity.

The lubricating grease composition may comprise:

0.01 wt % to 2 wt % of a compound of formula (I) as described herein;

1 wt % to 20 wt % of a grease thickener;

0.2 wt % to 1 wt % of an extreme pressure agent;

0.1 wt % to 10 wt % of other performance additives; and balance of an oil of lubricating viscosity.

The lubricating grease composition may comprise 0.02 wt % to 1.5 wt % of a compound of formula (I) as described herein;

1 wt % to 20 wt % of a grease thickener;

0.2 wt % to 1 wt % of an extreme pressure agent;

0.1 wt % to 10 wt % of other performance additives; and balance of an oil of lubricating viscosity.

The lubricating grease composition comprises an additive package composition, examples of which are shown in Table 4 below.

TABLE 4

Grease Additive Package Compositions*

| Additive | Embodiments (wt %) Multi-functional | High Temp-Long Life |
|---|---|---|
| Compound of formula (I) | 20-30 | 10 to 25 |
| Antioxidant | 10 to 20 | 25.0-60.0 |
| Dispersant | 0.50 to 5.0 | — |
| Metal Deactivator | 1.0 to 8.0 | — |
| Anti-wear Agent | — | 5.0 to 15.0 |
| Extreme Pressure Agent | 45.0 to 65.0 | 0.1 to 10.0 |
| Rust inhibitor | 1.0 to 5.0 | 30.0 to 40.0 |
| Diluent Oil | Balance to 100% | Balance to 100% |

*The grease additive package is treated at 2 wt % to 5 wt % of a grease composition.

In order to demonstrate improved performance in a lubricating grease composition, the composition may be evaluated versus control standards as to ASTM D471-12a: Standard Test Method for Rubber Property—Effect of Liquids. Hydraulics Oil, Turbine Oil or Circulating Oil In one embodiment, the lubricating composition is for use in a hydraulic system, turbine system or a circulating oil system. A hydraulic system is generally a device or apparatus in which a fluid, typically an oil-based fluid, transmits energy to different parts of the system by hydraulic force. A turbine lubricant is typically used to lubricate the gears or other moving parts of a turbine (or turbine system), such as a steam turbine or a gas turbine. A circulating oil is typically used to distribute heat to or through a device or apparatus through which it is circulated.

In one embodiment the lubricant composition contains the compound of formula (I) in an amount from 0.01 or 0.05 to 2 wt %, or 0.01 or 0.05 to 1.5 wt %, 0.05 to 1 wt %, 0.15 to 1 wt %, 0.15 to 0.5 wt % of the overall composition.

The lubricant compositions may also contain one or more additional additives. In some embodiments the additional additives may include an antioxidant, an anti-wear agent, a corrosion inhibitor, a rust inhibitor, a foam inhibitor, a dispersant, a demulsifier, a metal deactivator, a friction modifier, a detergent, an emulsifier, an extreme pressure agent, a pour point depressant, a viscosity modifier, or any combination thereof.

The lubricant may thus comprise an antioxidant, or mixtures thereof. The anti-oxidant may be present at 0 wt % to 4.0 wt %, or 0.02 wt % to 3.0 wt %, or 0.03 wt % to 1.5 wt % of the lubricant.

Anti-oxidants include diarylamine, alkylated diarylamines, hindered phenols, molybdenum compounds (such as molybdenum dithiocarbamates), hydroxyl thioethers, trimethyl polyquinoline (e.g., 1,2-dihydro-2,2,4-trimethylquinoline), or mixtures thereof.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines. In one embodiment, the diphenylamine is alkylated with a benzene and t-butyl substituent.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-ditert-butylphenol. In one embodiment the hindered phenol antioxidant may be an ester and may include, e.g., Irganox™ L-135 from BASF GmbH. A more detailed description of suitable ester-containing hindered phenol anti-oxidant chemistry is found in U.S. Pat. No. 6,559,105.

Examples of molybdenum dithiocarbamates, which may be used as an antioxidants, include commercial materials sold under the trade names such as Molyvan 822®, Molyvan® A, Molyvan® 855 and from R. T. Vanderbilt Co., Ltd., and Adeka Sakura-Lube™ S100, S165, S600 and S525, or mixtures thereof. An example of a dithiocarbamate which may be used as an anti-oxidant or anti-wear agent is Vanlube® 7723 from R. T. Vanderbilt Co., Ltd.

The antioxidant may include a substituted hydrocarbyl mono-sulfide represented by the formula:

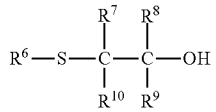

wherein $R^6$ may be a saturated or unsaturated branched or linear alkyl group with 8 to 20 carbon atoms; $R^7$, $R^8$, $R^9$ and $R^{10}$ are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol.

The lubricant compositions may also include a dispersant or mixtures thereof. Suitable dispersants include: (i) polyetheramines; (ii) borated succinimide dispersants; (iii) non-borated succinimide dispersants; (iv) Mannich reaction products of a dialkylamine, an aldehyde and a hydrocarbyl substituted phenol; or any combination thereof. In some embodiments the dispersant may be present at 0 wt % or 0.01 wt % to 2.0 wt %, 0.05 wt % to 1.5 wt %, or 0.005 wt % to 1 wt %, or 0.05 wt % to 0.5 wt % of the overall composition.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat.

Nos. 5,936,041, 5,643,859, and 5,627,259, and polyalkylene succinimide dispersants, described in U.S. Pat. Nos. 5,851,965, 5,853,434, and 5,792,729.

Anti-foam agents, also known as foam inhibitors, are known in the art and include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. In some embodiments the anti-foam is a polyacrylate. Antifoams may be present in the composition from 0.001 wt % to 0.012 wt % or 0.004 wt % or even 0.001 wt % to 0.003 wt %.

Demulsifiers are known in the art and include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. Demulsifiers may be present in the composition from 0.002 wt % to 0.012 wt %.

Pour point depressants are known in the art and include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant composition may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid, an ammonium sulfonate, an imidazoline, alkylated succinic acid derivatives reacted with alcohols or ethers, or any combination thereof; or mixtures thereof.

Suitable hydrocarbyl amine salts of alkylphosphoric acid may be represented by the following formula:

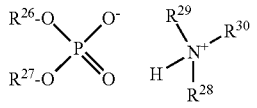

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid is the reaction product of a $C_{14}$ to $C_{18}$ alkylated phosphoric acid with Primene® 81R (produced and sold by Rohm & Haas) which is a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene® 81R or mixtures thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid. An example of a suitable ester of a nitrogen-containing carboxylic acid includes oleyl sarcosine.

The rust inhibitors may be present in the range from 0 or 0.02 wt % to 0.2 wt %, from 0.03 wt % to 0.15 wt %, from 0.04 wt % to 0.12 wt %, or from 0.05 wt % to 0.1 wt % of the lubricating oil composition. The rust inhibitors may be used alone or in mixtures thereof.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors.

The metal deactivators may be present in the range from 0 or 0.001 wt % to 0.1 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

In one embodiment the invention provides a lubricant composition further comprises a metal-containing detergent. The metal-containing detergent may be a calcium or magnesium detergent. The metal-containing detergent may also be an overbased detergent with total base number ranges from 30 to 500 mg KOH/g Equivalents.

The metal-containing detergent may be chosen from non-sulfur containing phenates, sulfur containing phenates, sulfonates, salixarates, salicylates, and mixtures thereof, or borated equivalents thereof. The metal-containing detergent may be may be chosen from non-sulfur containing phenates, sulfur containing phenates, sulfonates, and mixtures thereof. The detergent may be borated with a borating agent such as boric acid such as a borated overbased calcium or magnesium sulfonate detergent, or mixtures thereof. The detergent may be present at 0 wt % to 5 wt %, or 0.001 wt % to 1.5 wt %, or 0.005 wt % to 1 wt %, or 0.01 wt % to 0.5 wt % of the hydraulic composition.

The lubricant may comprise an extreme pressure agent. The extreme pressure agent may be a compound containing sulfur and/or phosphorus. Examples of extreme pressure agents include polysulfides, sulfurized olefins, thiadiazoles, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

The polysulfide may include a sulfurized organic polysulfide from oils, fatty acids or esters, olefins, or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene or mixtures thereof. In one embodiment the polysulfide comprises a polyolefin derived from polymerizing by known techniques an olefin as described above. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present at 0 wt % to 3 wt %, 0.005 wt % to 2 wt %, 0.01 wt % to 1.0 wt % of the hydraulics composition.

The lubricant may further comprise a viscosity modifier, or mixtures thereof. Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth)acrylic acid ester, a polyalkylstyrene, an hydrogenated alkenylaryl conjugated-diene copolymer, an ester of maleic anhydride-styrene copolymer or mixtures thereof. In some embodiments the viscosity modifier is a poly(meth) acrylic acid ester, an olefin copolymer or mixtures thereof. The viscosity modifiers may be present at 0 wt % to 10 wt %, 0.5 wt % to 8 wt %, 1 wt % to 6 wt % of the lubricant.

In one embodiment the lubricant disclosed herein may contain at least one friction modifier. The friction modifier may be present at 0 wt % to 3 wt %, or 0.02 wt % to 2 wt %, or 0.05 wt % to 1 wt %, of the lubricant composition.

As used herein the term "fatty alkyl" or "fatty" in relation to friction modifiers can mean a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

In one embodiment the lubricant composition further includes an anti-wear agent. Typically the anti-wear agent may be a phosphorus anti-wear agent or mixtures thereof. The anti-wear agent may be present at 0 wt % to 5 wt %, 0.001 wt % to 2 wt %, 0.01 wt % to 1.0 wt % of the lubricant.

The phosphorus anti-wear agent may include a phosphorus amine salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof, and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulfur atom in the molecule.

Examples of the anti-wear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof. Mixtures of amines may also be used. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment oil soluble amine salts of phosphorus compounds include a sulfur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in U.S. Pat. No. 8,361,941.

In one embodiment the hydrocarbyl amine salt of an alkylphosphoric acid ester is the reaction product of a C14 to C18 alkylated phosphoric acid with Primene 81R® (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents, and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulfur, and an acid number of 87 (bromophenol blue).

In one embodiment the anti-wear additives may include a zinc dialkyldithiophosphate. In other embodiments the compositions of the present invention are substantially free of, or even completely free of zinc dialkyldithiophosphate.

In one embodiment the invention provides for a composition that includes a dithiocarbamate antiwear agent defined in U.S. Pat. No. 4,758,362 column 2, line 35 to column 6, line 11. When present the dithiocarbamate antiwear agent may be present from 0.25 wt %, 0.3 wt %, 0.4 wt % or even 0.5 wt % up to 0.75 wt %, 0.7 wt %, 0.6 wt % or even 0.55 wt % in the overall composition.

A hydraulic lubricant may thus comprise:

0.01 wt % to 2 wt % of a compound of formula (I), 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0 wt % to 1.5 wt % of a borated succinimide or a non-borated succinimide dispersant, 0.001 wt % to 1.5 wt % of a neutral or slightly overbased calcium naphthalene sulfonate (typically a neutral or slightly overbased calcium dinonyl naphthalene sulfonate), and 0.001 wt % to 2 wt %, or 0.01 wt % to 1 wt % of an anti-wear agent chosen from zinc dialkyldithiophosphate, zinc dialkylphosphate, amine salt of a phosphorus acid ester, or mixtures thereof.

A hydraulic lubricant may thus comprise:

0.01 wt % to 1.5 wt % of a compound of formula (I), 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide dispersant, 0.001 wt % to 1.5 wt % of a neutral or slightly overbased calcium naphthalene sulfonate (typically a neutral or slightly overbased calcium dinonyl naphthalene sulfonate), and 0.001 wt % to 2 wt %, or 0.01 wt % to 1 wt % of an anti-wear agent chosen from zinc dialkyldithiophosphate, zinc dialkylphosphate, amine salt of a phosphorus acid ester, or mixtures thereof.

A hydraulic lubricant may also comprise a formulation defined in the following table:

TABLE 5

Hydraulic Lubricant compositions

| | Embodiments (wt %) | | |
|---|---|---|---|
| Additive | A | B | C |
| Seal Swell Agent of the invention (compound of formula (I)) | 0.01 to 2.0 | 0.01 to 1.5 | 0.01 to 1.0 |
| Antioxidant | 0 to 4.0 | 0.02 to 3.0 | 0.03 to 1.5 |
| Dispersant | 0 to 2.0 | 0.005 to 1.5 | 0.01 to 1.0 |
| Detergent | 0 to 5.0 | 0.001 to 1.5 | 0.005 to 1.0 |
| Anti-wear Agent | 0 to 5.0 | 0.001 to 2 | 0.1 to 1.0 |
| Friction Modifier | 0 to 3.0 | 0.02 to 2 | 0.05 to 1.0 |
| Viscosity Modifier | 0 to 10.0 | 0.5 to 8.0 | 1.0 to 6.0 |
| Any Other Performance Additive(antifoam/demulsifier/pour point depressant) | 0 to 1.3 | 0.00075 to 0.5 | 0.001 to 0.4 |
| Metal Deactivator | 0 to 0.1 | 0.01 to 0.04 | 0.015 to 0.03 |
| Rust Inhibitor | 0 to 0.2 | 0.03 to 0.15 | 0.04 to 0.12 |

TABLE 5-continued

| Hydraulic Lubricant compositions | | | |
|---|---|---|---|
| | Embodiments (wt %) | | |
| Additive | A | B | C |
| Extreme Pressure Agent | 0 to 3.0 | 0.005 to 2 | 0.01 to 1.0 |
| Oil of Lubricating Viscosity | Balance to 100% | Balance to 100% | Balance to 100% |

Specific examples of a hydraulic lubricant include those summarized in the following table:

TABLE 6

| Hydraulic Lubricant compositions | | | |
|---|---|---|---|
| | Embodiments (wt %) | | |
| Additive | A | B | C |
| Seal Swell Agent of the invention (compound of formula (I)) | 0.2 | 0.25 | 0.5 |
| Antioxidant-aminic/phenolic | 0.4 | 0.4 | 0.4 |
| Calcium Sulfonate Detergent | 0.2 | 0.2 | 0.2 |
| Zinc dialkyl dithiophosphate | 0.3 | 0.15 | 0 |
| Any Other Performance Additive (antifoam/demulsifier/pour point depressant) | 0.01 | 0.01 | 0.01 |
| Triazole Metal Deactivator | 0.005 | 0.005 | 0.005 |
| Oil of Lubricating Viscosity | Balance to 100% | Balance to 100% | Balance to 100% |

Seal swelling performance of the hydraulic lubricant compositions may be evaluated in accordance with ASTM D471-12a: Standard Test Method for Rubber Property—Effect of Liquids.

Industrial Gears

Gear lubricants have traditionally been divided into two categories: industrial and automotive. The distinction between the two essentially lies in the type of gears they lubricate and the environment to which the gear unit is exposed. Automotive gear lubricants primarily lubricate spiral-bevel gears in on- and off-highway truck axles, and hypoid gears in vehicles that include trucks and passenger cars. Industrial gear lubricants work under much more diverse conditions and applications that lubricants from automotive gears. For example, industrial gear sets may require a lubricant that can function in the presence of large quantities of water, as is found in steel mills, or in the highly contaminated environment of a mine or quarry, while sustaining high loads, speeds and operating temperatures. Most industrial gear sets are steel-on-steel, but some worm gears are bronze-on-steel. Industrial gears can be as large as 10 meters in diameter and incorporate spur, bevel, helical and spiral bevel designs in an endless variety of configurations. Industrial gear lubricants are versatile lubricants and can be found in a wide variety applications, from rock drill oils in the mining industry to oil mist lubrication systems in steel mills and other manufacturing applications. Industrial gear lubricants are also used in energy production and construction applications.

The lubricants of the disclosed technology may include an oil of lubricating viscosity and an industrial additive package. The industrial additive package may also be referred to as an industrial lubricant additive package or an industrial gear lubricant additive package. In other words, the lubricants are designed to be industrial lubricants, or additive packages for making the same. Such lubricants do not relate to automotive gear lubricants.

The industrial lubricant additive package comprises the seal swell agent of the invention and, optionally, other performance additives. For example, the industrial lubricant additive package may include a demulsifier, a dispersant, and a metal deactivator, in addition to the seal swell agent of the invention. Any combination of conventional additive packages designed for industrial application may be used as to provide the other performance additives for the industrial lubricant additive package disclosed herein.

Additives which may be present in the industrial additive package include a foam inhibitor, a demulsifier, a pour point depressant, an antioxidant, a dispersant, a metal deactivator (such as a copper deactivator), an anti-wear agent, an extreme pressure agent, a viscosity modifier, or some mixture thereof. The additives (other than the seal swell agent of the invention) may each be present in the range from 50 ppm, 75 ppm, 100 ppm or even 150 ppm up to 5 wt %, 4 wt %, 3 wt %, 2 wt % or even 1.5 wt %, or from 75 ppm to 0.5 wt %, from 100 ppm to 0.4 wt %, or from 150 ppm to 0.3 wt %, where the wt % values are with regards to the overall lubricant composition. In other embodiments the overall industrial additive package (which includes the seal swell agent of the invention) may be present from 1 to 20, or from 1 to 10 wt % of the overall lubricant composition. However it is noted that some additives, including viscosity modifying polymers, which may alternatively be considered as part of the base fluid, may be present in higher amounts including up to 30 wt %, 40 wt %, or even 50 wt % when considered separate from the base fluid. The additives may be used alone or as mixtures thereof.

The industrial gear lubricating composition may comprise a compound of formula (I) in an amount from 0.01 or 0.05 to 2 wt %, or 0.01 or 0.05 to 1.5 wt %, 0.05 to 1 wt %, 0.15 to 1 wt %, 0.15 to 0.5 wt % of the overall composition.

The lubricant may include anti-foam agent. The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments the anti-foam agent may be a polyacrylate. Anti-foam agents may be present in the lubricating composition from 0.001 wt % to 0.012 wt % or 0.004 wt % or even 0.001 wt % to 0.003 wt %.

The lubricant may also include demulsifier. The demulsifier may include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of a demulsifier include polyethylene glycols, polyethylene oxides, polypropylene oxides, (ethylene oxide-propylene oxide) polymers and mixtures thereof. The demulsifier may be a polyether. The demulsifier may be present in the lubricating composition from 0.002 wt % to 0.2 wt %.

The lubricant may include a pour point depressant. The pour point depressant may include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

Various lubricants may also contain other additive components. One such component is a metal-containing detergent. Detergents are typically, but not necessarily, overbased materials, otherwise referred to as overbased or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis. Some useful detergents may have a TBN of 100 to 800, or 150 to 750, or, 400 to 700. Substantially neutral detergents will have a lower TBN. "Slightly overbased" detergents may have a TBN of less than 100, or less than 75, or 10 to 70, or 20 to 50, or 0 to 20 mg KOH/g.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium.

The detergent may be a sulfonate detergent, a phenate detergent, a saligenin detergent, a salicylate detergent, a salixarate detergent, or a glyoxylate detergent. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." Overbased salicylate detergents and their methods of preparation are disclosed in U.S. Pat. Nos. 4,719,023 and 3,372,116.

The amount of the overbased detergent, if present, may be present in an amount of at least 0.05 weight percent on an oil-free basis, or 0.7 to 5 weight percent or 1 to 3 weight percent, or 0.05-3, or 0.1-2.8, or 0.1-2.5, or 0.2-2 weight percent of the lubricating composition. Either a single detergent or multiple detergents can be present.

In one embodiment the lubricant composition further includes an anti-wear agent. Typically the anti-wear agent may be a phosphorus anti-wear agent or mixtures thereof. The anti-wear agent may be present at 0 wt % to 5 wt %, 0.001 wt % to 2 wt %, 0.01 wt % to 1.0 wt % of the lubricant.

The phosphorus anti-wear agent may include a phosphorus amine salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulfur atom in the molecule.

Examples of the anti-wear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof. Mixtures of amines may also be used. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment oil soluble amine salts of phosphorus compounds include a sulfur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in U.S. Pat. No. 8,361,941.

In one embodiment the hydrocarbyl amine salt of an alkylphosphoric acid ester is the reaction product of a C14 to C18 alkylated phosphoric acid with Primene 81R® (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents, and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulfur, and an acid number of 87 (bromophenol blue).

In one embodiment the anti-wear additives may include a zinc dialkyldithiophosphate. In other embodiments the compositions of the present invention are substantially free of, or even completely free of zinc dialkyldithiophosphate.

The lubricant may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid, an ammonium sulfonate, an imidazoline, or any combination thereof; or mixtures thereof.

Suitable hydrocarbyl amine salts of alkylphosphoric acid may be represented by the following formula:

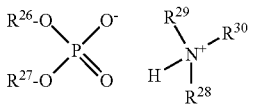

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid may be the reaction product of a $C_{14}$ to $C_{18}$ alkylated phosphoric acid with Primene 81R (produced and sold by Rohm & Haas) which may be a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R® or mixtures thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid. An example of a suitable ester of a nitrogen-containing carboxylic acid includes oleyl sarcosine.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors. The metal deactivators may be present in the range from 0.0001 wt % to 0.5 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

The lubricants may also include antioxidant, or mixtures thereof. The antioxidants, including (i) an alkylated diphenylamine, and (ii) a substituted hydrocarbyl mono-sulfide. In some embodiments the alkylated diphenylamines include bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl mono-sulfide may be 1-(tert-dodecylthio)-2-propanol. The antioxidant package may also include sterically hindered phenols. Examples of suitable hydrocarbyl groups for the sterically hindered phenols include 2-ethylhexyl or n-butyl ester, dodecyl or mixtures thereof. Examples of methylene-bridged sterically hindered phenols include 4,4'-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof.

The anti-oxidants may be present in the composition from 0.01 wt % to 6.0 wt % or from 0.02 wt % to 3 wt % or to 1 wt %. The additive may be present in the composition at 3 wt %, 2 wt %, 1 wt %, 0.5 wt %, or less.

The lubricant may also include nitrogen-containing dispersants, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof. The amount of the dispersant in a fully formulated lubricant of the present technology, if it is present, may be at least 0.005 wt % of the lubricant composition or at least 0.01 wt % or 0.1 wt % or 0.3 wt % or 0.5 wt % or 1 wt % and in certain embodiments at most 2 wt % or 1.5 wt %.

The lubricant may also include extreme pressure agents such as sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples the sulfur-containing compound is a sulfurized olefin derived from any of the natural oils or synthetic oils described above, or even some combination thereof. For example the sulfurized olefin may be derived from vegetable oil. The sulfurized olefin may be present in the lubricant composition from 0 wt % to 5.0 wt % or from 0.01 wt % to 4.0 wt % or from 0.1 wt % to 3.0 wt %.

The lubricant may also include phosphorus containing compound, such as a fatty phosphite. The phosphorus containing compound may include a hydrocarbyl phosphite, a phosphoric acid ester, an amine salt of a phosphoric acid ester, or any combination thereof. In some embodiments the phosphorus containing compound includes a hydrocarbyl phosphite, an ester thereof, or a combination thereof. In some embodiments the phosphorus containing compound includes a hydrocarbyl phosphite. In some embodiments the hydrocarbyl phosphite may be an alkyl phosphite. By alkyl it is meant an alkyl group containing only carbon and hydrogen atoms, however either saturated or unsaturated alkyl groups are contemplated or mixtures thereof. In some embodiments the phosphorus containing compound includes an alkyl phosphite that has a fully saturated alkyl group. In some embodiments the phosphorus containing compound includes an alkyl phosphite that has an alkyl group with some unsaturation, for example, one double bond between carbon atoms. Such unsaturated alkyl groups may also be referred to as alkenyl groups, but are included within the term "alkyl group" as used herein unless otherwise noted. In some embodiments the phosphorus containing compound includes an alkyl phosphite, a phosphoric acid ester, an amine salt of a phosphoric acid ester, or any combination thereof. In some embodiments the phosphorus containing compound includes an alkyl phosphite, an ester thereof, or a combination thereof. In some embodiments the phosphorus containing compound includes an alkyl phosphite. In some embodiments the phosphorus containing compound includes an alkenyl phosphite, a phosphoric acid ester, an amine salt of a phosphoric acid ester, or any combination thereof. In some embodiments the phosphorus containing compound includes an alkenyl phosphite, an ester thereof, or a combination thereof. In some embodiments the phosphorus containing compound includes an alkenyl phosphite. In some embodiments the phosphorus containing compound includes dialkyl hydrogen phosphites. In some embodiments the phosphorus-containing compound is essentially free of, or even completely free of, phosphoric acid esters and/or amine salts thereof. In some embodiments the phosphorus-containing compound may be described as a fatty phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite. In one embodiment the phosphite may be sulfur-free i.e., the phosphite is not a thiophosphite. The phosphite having at least one hydrocarbyl group with 4 or more carbon atoms may be represented by the formulae:

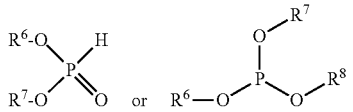

wherein at least one of $R^6$, $R^7$ and $R^8$ may be a hydrocarbyl group containing at least 4 carbon atoms and the other may be hydrogen or a hydrocarbyl group. In one embodiment $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups.

The alkyl groups may be linear or branched, typically linear, and saturated or unsaturated, typically saturated. Examples of alkyl groups for $R^6$, $R^7$ and $R^8$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In some embodiments the fatty phosphite component of the lubricant composition overall is essentially free of, or even completely free of phosphoric acid ester and/or amine salts thereof. In some embodiments the fatty phosphite comprises an alkenyl phosphite or esters thereof, for example esters of dimethyl hydrogen phosphite. The dimethyl hydrogen phosphite may be esterified, and in some embodiments transesterified, by reaction with an alcohol, for example oleyl alcohol.

The lubricant may also include one or more phosphorous amine salts. In certain embodiments the amount thereof will be such that the additive package, or in other embodiments the resulting industrial lubricant compositions, contains no more than 1.0 wt % of such materials, or even no more than 0.75 wt % or 0.6 wt %. In other embodiments the industrial lubricant additive packages, or the resulting industrial lubricant compositions, are essentially free of or even completely free of phosphorous amine salts.

The lubricant may also include a friction modifier, for example, a derivative of a hydroxy-carboxylic acid. Suitable acids may include from 1 to 5 or 2 carboxy groups or from 1 to 5 or 2 hydroxy groups. In some embodiments the friction modifier may be derivable from a hydroxy-carboxylic acid represented by the formula:

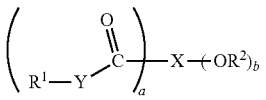

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N< formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is a or 3 to at least one of the —C(O)—Y—$R^1$ groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive. In one embodiment the hydroxy-carboxylic acid used in the preparation of the derivative of a hydroxy-carboxylic acid is represented by the formula:

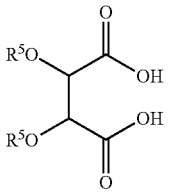

wherein each $R^5$ may independently be H or a hydrocarbyl group, or wherein the $R^5$ groups together form a ring. In one embodiment, where $R^5$ is H, the condensation product is optionally further functionalized by acylation or reaction with a boron compound. In another embodiment the friction modifier is not borated. In any of the embodiments above, the hydroxy-carboxylic acid may be tartaric acid, citric acid, or combinations thereof, and may also be a reactive equivalent of such acids (including esters, acid halides, or anhydrides).

The resulting friction modifiers may include imide, di-ester, di-amide, or ester-amide derivatives of tartaric acid, citric acid, or mixtures thereof. In one embodiment the derivative of hydroxycarboxylic acid includes an imide, a di-ester, a di-amide, an imide amide, an imide ester or an ester-amide derivative of tartaric acid or citric acid. In one embodiment the derivative of hydroxycarboxylic acid includes an imide, a di-ester, a di-amide, an imide amide, an imide ester or an ester-amide derivative of tartaric acid. In one embodiment the derivative of hydroxycarboxylic acid includes an ester derivative of tartaric acid. In one embodiment the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments the alcohols and/or amines used include branched compounds, and in still other embodiments, the alcohols and amines used are at least 50%, 75% or even 80% branched. In other embodiments the alcohols are linear. In some embodiments, the alcohol and/or amine have at least 6 carbon atoms. Accordingly, certain embodiments the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments the product prepared from linear alcohols of at least 6 carbon atoms, for instance, linear $C_{6-18}$ or $C_{8-18}$ alcohols or linear $C_{12-16}$ alcohols, either as single materials or as mixtures. The tartaric acid used for preparing the tartrates, tartrimides, or tartramides may be the commercially available type (obtained from Sargent Welch), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

The lubricant may include one or more anti-wear additives and/or extreme pressure agents, one or more rust and/or corrosion inhibitors, one or more foam inhibitors, one or more demulsifiers, or any combination thereof.

In some embodiments the industrial lubricant additive packages, or the resulting industrial lubricant compositions, are essentially free of or even completely free of phosphorous amine salts, dispersants, or both.

In some embodiments the industrial lubricant additive packages, or the resulting industrial lubricant compositions, include a demulsifier, a corrosion inhibitor, a friction modifier, or combination of two or more thereof. In some embodiments the corrosion inhibitor includes a tolyltriazole. In still other embodiments the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester co-polymers; one or more carboxylic esters; one or more succinimide dispersants, or any combination thereof.

The industrial lubricant additive package may be present in the overall industrial lubricant from 1 wt % to 5 wt %, or in other embodiments from 1 wt %, 1.5 wt %, or even 2 wt % up to 2 wt %, 3 wt %, 4 wt %, 5 wt %, 7 wt % or even 10 wt %. Amounts of the industrial gear additive package that may be present in the industrial gear concentrate lubricant are the corresponding amounts to the wt % above, where the values are considered without the oil present (i.e., they may be treated as wt % values along with the actual amount of oil present).

In some embodiments the additive package includes one or more corrosion inhibitors, one or more dispersants, one or more anti-wear and/or extreme pressure additives, one or more extreme pressure agents, one or more antifoam agents, one or more detergents, and optionally some amount of base oil or similar solvent as a diluent.

The additional additives may be present in the overall industrial gear lubricant composition from 0.1 wt % to 30 wt %, or from a minimum level of 0.1 wt %, 1 wt % or even 2 wt % up to a maximum of 30 wt %, 20 wt %, 10 wt %, 5 wt %, or even 2 wt %, or from 0.1 wt % to 30 wt %, from 0.1 wt % to 20 wt %, from 1 wt % to 20 wt %, from 1 wt % to 10 wt %, from 1 wt % to 5 wt %, or even about 2 wt %. These ranges and limits may be applied to each individual additional additive present in the composition, or to all of the additional additives present.

The industrial gear lubricant may thus comprise:

0.01 wt % to 2 wt % of the compound of formula (I), 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral or slightly overbased calcium naphthalene sulfonate (typically a neutral or slightly overbased calcium dinonyl naphthalene sulfonate), 0.001 wt % to 2 wt %, or 0.01 wt % to 1 wt % of an anti-wear agent chosen from zinc dialkyldithiophosphate, zinc dialkylphosphate, amine salt of a phosphorus acid ester, or mixtures thereof, and 0.01 to 5 wt % of an extreme pressure additive chosen form a sulfurized olefin and a polysulfide.

The industrial gear lubricant may also comprise a formulation as defined in the following table:

TABLE 7

Industrial Gear Lubricant compositions

| Additive | Embodiments (wt %) A | B | C |
|---|---|---|---|
| Compound of formula (I) | 0.01 to 2.0 | 0.05 to 1.5 | 0.1 to 1.5 |
| Extreme pressure agent | 0 to 5.0 | 0.01 to 4.0 | 0.1 to 3 |
| Dispersant | 0 to 2.0 | 0.005 to 1.5 | 0.01 to 1.0 |
| Antifoam Agent | 0.001 to 0.012 | 0.001 to 0.004 | 0.001 to 0.003 |
| Demulsifier | 0.002 to 2 | .0025 to 0.5 | 0.005 to 0.04 |
| Metal Deactivator | 0.001 to 0.5 | 0.01 to 0.04 | 0.015 to 0.03 |
| Rust Inhibitor | 0.001 to 1.0 | 0.005 to 0.5 | 0.01 to 0.25 |
| Antiwear agent | 0 to 3.0 | 0.005 to 2 | 0.01 to 1.0 |
| Oil of Lubricating Viscosity | Balance to 100% | Balance to 100% | Balance to 100% |

Specific examples of an industrial gear lubricant include those summarized in the following table:

TABLE 8

Industrial Gear Lubricant compositions

| Additive | Embodiments (wt %) A | B | C |
|---|---|---|---|
| Compound of formula (I) | 0.5 | 1.0 | 1.5 |
| Dispersant | 0.1 | 0.1 | 0.1 |
| Polyacrylate Antifoam Agent | 0.02 | 0.02 | 0.02 |
| Alkoxylated Demulsifier | 0.01 | 0.01 | 0.01 |
| Thiazole/Triazole Metal Deactivators | 0.035 | 0.035 | 0.035 |
| Fatty Amine Rust Inhibitor | 0.05 | 0.05 | 0.05 |
| Extreme pressure agent | 1.0 | 1.0 | 1.0 |
| Oil of Lubricating Viscosity | Balance to 100% | Balance to 100% | Balance to 100% |

Seal swelling performance of the industrial gear lubricant compositions may be evaluated in accordance with ASTM D471-12a: Standard Test Method for Rubber Property—Effect of Liquids.

Gas Compressor Lubricants

In one embodiment the lubricant disclosed herein may be a gas compressor or a refrigeration lubricant. The compound of formula (I) can be present in an amount of from 0.01 or 0.05 to 2 wt %, or 0.01 or 0.05 to 1.5 wt %, 0.05 to 1 wt %, 0.15 to 1 wt %, 0.15 to 0.5 wt % based on the weight of the lubricant. The working fluid can include a lubricant comprised of (i) one or more ester base oils, (ii) one or more mineral oil base oils, (iii) one or more polyalphaolefin (PAO) base oils, (iv) one more alkyl benzene base oils, (v) one or more polyalkylene glycol (PAG) base oils, (vi) one or more alkylated naphthalene base oils, (vii) one or more polyvinylether base oils, (viii) one or more polyolester (POE) base oils, or any combination thereof to form an oil of lubricating viscosity and 0.01 wt % to 2 wt % of a compound of formula (I). The lubricant may be a working fluid in a compressor used for refrigeration or gas compression. In one embodiment the working fluid may be for a low Global Warming Potential (low GWP) refrigerant system. The working fluid can include a lubricant comprised of ester base oils, mineral oil base oils, polyalphaolefin base oils, polyalkylene glycol base oils or polyvinyl ether base oils alone or in combination to form an oil of lubricating viscosity and 0.01 wt % to 2 wt % of a compound of formula (I) and a refrigerant or gas to be compressed. The ester based oil includes an ester of one or more branched or linear carboxylic acids from C4 to C13. The ester is generally formed by the reaction of the described branched carboxylic acid and one or more polyols.

In some embodiments, the branched carboxylic acid contains at least 5 carbon atoms. In some embodiments, the branched carboxylic acid contains from 4 to 9 carbon atoms. In some embodiments, the polyol used in the preparation of the ester includes neopentyl glycol, glycerol, trimethylol propane, pentaerythritol, dipentaerythritol, tripentaerythritol, or any combination thereof. In some embodiments, the polyol used in the preparation of the ester includes neopentyl glycol, pentaerythritol, dipentaerythritol, or any combination thereof. In some embodiments, the polyol used in the preparation of the ester includes neopentyl glycol. In some embodiments, the polyol used in the preparation of the ester includes pentaerythritol. In some embodiments, the polyol used in the preparation of the ester includes dipentaerythritol.

In some embodiments, the ester is derived from (i) an acid that includes 2-methylbutanoic acid, 3-methylbutanoic acid, or a combination thereof; and (ii) a polyol that includes neopentyl glycol, glycerol, trimethylol propane, pentaerythritol, dipentaerythritol, tripentaerythritol, or any combination thereof.

The lubricant may have the ability to provide an acceptable viscosity working fluid that has good miscibility.

By "acceptable viscosity" it is meant the ester based lubricant and/or the working fluid has a viscosity (as measured by ASTM D445 at 40° C.) of more than 4 $mm^2 s^{-1}$. In some embodiments, the ester based lubricant and/or the working fluid has a viscosity at 40° C. from 5 or 32 $mm^2 s^{-1}$ up to 320, 220, 120, or even 68 $mm^2 s^{-1}$.

As noted by above, by "low GWP", it is meant the working fluid has a GWP value (as calculated per the Intergovernmental Panel on Climate Change's 2001 Third Assessment Report) of not greater than 1000, or a value that is less than 1000, less than 500, less than 150, less than 100, or even less than 75. In some embodiments, this GWP value is with regards to the overall working fluid. In other embodiments, this GWP value is with regards to the refrigerant present in the working fluid, where the resulting working fluid may be referred to as a low GWP working fluid.

By "good miscibility" it is meant that the refrigerant or compressed gas and lubricant are miscible, at least at the operating conditions the described working fluid will see during the operation of a refrigeration or gas compression system. In some embodiments, good miscibility may mean that the working fluid (and/or the combination of refrigerant and lubricant) does not show any signs of poor miscibility other than visual haziness at temperatures as low as 0° C., or even −25° C., or even in some embodiments as low as −50° C., or even −60° C.

In some embodiments, the described working fluid may further include one or more additional lubricant components. These additional lubricant components may include (i) one or more esters of one or more linear carboxylic acids, (ii) one or more polyalphaolefin (PAO) base oils, (iii) one more alkyl benzene base oils, (iv) one or more polyalkylene glycol (PAG) base oils, (v) one or more alkylated naphthalene base oils, or (vi) any combination thereof.

Additional lubricants that may be used in the described working fluids include certain silicone oils and mineral oils.

Commercially available mineral oils include Sonneborn® LP 250 commercially available from Sonneborn, Suniso® 3GS, 1GS, 4GS, and 5GS, each commercially available from Sonneborn, and Calumet R015 and RO30 commercially available from Calumet. Commercially available alkyl benzene lubricants include Zerol® 150 and Zerol® 300 commercially available from Shrieve Chemical. Commercially available esters include neopentyl glycol dipelargonate, which is available as Emery® 2917 and Hatcol® 2370. Other useful esters include phosphate esters, dibasic acid esters, and fluoroesters. Of course, different mixtures of different types of lubricants may be used.

In some embodiments, the described working fluid further includes one or more esters of one or more linear carboxylic acids.

The working fluids may also include one or more refrigerants. Suitable non-low GWP refrigerants useful in such embodiments are not overly limited. Examples include R-22, R-134a, R-125, R-143a, or any combination thereof. In some embodiments at least one of the refrigerants is a low GWP refrigerant. In some embodiments, all of the refrigerants present in the working fluid are low GWP refrigerants. In some embodiments, the refrigerant includes R-32, R-290, R-1234yf, R-1234ze(E), R-744, R-152a, R-600, R-600a or any combination thereof. In some embodiments, the refrigerant includes R-32, R-290, R-1234yf, R-1234ze(E) or any combination thereof. In some embodiments, the refrigerant includes R-32. In some embodiments the refrigerant includes R-290. In some embodiments, the refrigerant includes R-1234yf. In some embodiments, the refrigerant includes R-1234ze(E). In some embodiments, the refrigerant includes R-744. In some embodiments, the refrigerant includes R-152a. In some embodiments, the refrigerant includes R-600. In some embodiments, the refrigerant includes R-600a.

In some embodiments, the refrigerant includes R-32, R-600a, R-290, DR-5, DR-7, DR-3, DR-2, R-1234yf, R-1234ze(E), XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-744, R-1270, or any combination thereof. In some embodiments, the refrigerant includes R-32, R-600a, R-290, DR-5, DR-7, DR-3, DR-2, R-1234yf, R-1234ze(E), XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-1270, or any combination thereof.

It is noted that the described working fluids may in some embodiments also include one or more non-low GWP refrigerant, blended with the low GWP refrigerant, resulting in a low GWP working fluid. Suitable non-low GWP refrigerants useful in such embodiments are not overly limited. Examples include R-22, R-134a, R-125, R-143a, or any combination thereof.

The described working fluids, at least in regards to how they would be found in the evaporator of the refrigeration system in which they are used, may be from 5 to 50 wt % lubricant, and from 95 to 50 wt % refrigerant. In some embodiments, the working fluid is from 10 to 40 wt % lubricant, or even from 10 to 30 or 10 to 20 wt % lubricant.

The described working fluids, at least in regards to how they would be found in the sump of the refrigeration system in which they are used, may be from 1 to 50, or even 5 to 50 wt % refrigerant, and from 99 to 50 or even 95 to 50 wt % lubricant. In some embodiments, the working fluid is from 90 to 60 or even 95 to 60 wt % lubricant, or even from 90 to 70 or even 95 to 70, or 90 to 80 or even 95 to 80 wt % lubricant.

The described working fluids may include other components for the purpose of enhancing or providing certain functionality to the composition, or in some cases to reduce the cost of the composition.

The described working fluids may further include one or more performance additives. Suitable examples of performance additives include anti-oxidants, metal passivators and/or deactivators, corrosion inhibitors, anti-foams, anti-wear inhibitors, corrosion inhibitors, pour point depressants, viscosity improvers, tackifiers, metal deactivators, extreme pressure additives, friction modifiers, lubricity additives, foam inhibitors, emulsifiers, demulsifiers, acid catchers, or mixtures thereof.

In some embodiments, the lubricant compositions include an antioxidant. In some embodiments, the lubricant compositions include a metal passivator, wherein the metal passivator may include a corrosion inhibitor and/or a metal deactivator. In some embodiments, the lubricant compositions include a corrosion inhibitor. In still other embodiments, the lubricant compositions include a combination of a metal deactivator and a corrosion inhibitor. In still further embodiments, the the lubricant compositions include the combination of an anti-oxidant, a metal deactivator and a corrosion inhibitor. In any of these embodiments, the lubricant compositions include one or more additional performance additives.

The antioxidants include butylated hydroxytoluene (BHT), butylatedhydroxyanisole (BHA), phenyl-a-naphthylamine (PANA), octylated/butylated diphenylamine, high molecular weight phenolic antioxidants, hindered bis-phenolic anti-oxidant, di-alpha-tocopherol, di-tertiary butyl phenol. Other useful anti-oxidants are described in U.S. Pat. No. 6,534,454.

In some embodiments, the antioxidant includes one or more of:

(i) Hexamethylenebis(3,5-di-tert-butyl-4-hydroxyhydrocinnamate), CAS registration number 35074-77-2, available commercially from BASF;

(ii) N-phenylbenzenamine, reaction products with 2,4,4-trimethylpentene, CAS registration number 68411-46-1, available commercially from BASF;

(iii) Phenyl-a-and/or phenyl-b-naphthylamine, for example N-phenyl-ar-(1,1,3,3-tetramethylbutyl)-1-naphthalenamine, available commercially from BASF;

(iv) Tetrakis[methylene(3,5-di-tert-butyl-4-hydroxyhydrocinnamate)] methane, CAS registration number 6683-19-8;

(v) Thiodiethylenebis (3,5-di-tert-butyl-4-hydroxyhydrocinnamate), CAS registration number 41484-35-9, which is also listed as thiodiethylenebis (3,5-di-tert-butyl-4-hydroxyhydro-cinnamate) in 21 C.F.R. § 178.3570;

(vi) Butylatedhydroxytoluene (BHT);

(vii) Butylatedhydroxyanisole (BHA), (viii) Bis(4-(1,1,3,3-tetramethylbutyl)phenyl)amine, available commercially from BASF; and (ix) Benzenepropanoic acid, 3,5-bis(1,1-dimethylethyl)-4-hydroxy-, thiodi-2,1-ethanediyl ester, available commercially from BASF.

The anti-oxidants may be present in the composition from 0 or 0.01% to 6.0% or from 0.02%, to 1%. The additive may be present in the composition at 1%, 0.5%, or less. These various ranges are typically applied to all of the anti-oxidants present in the overall composition. However, in some embodiments, these ranges may also be applied to individual antioxidants.

The metal passivators include both metal deactivators and corrosion inhibitors.

Suitable metal deactivators include triazoles or substituted triazoles. For example, tolyltriazole or tolutriazole may be utilized. Suitable examples of metal deactivator include one or more of:

(i) One or more tolu-triazoles, for example N,N-Bis(2-ethylhexyl)-ar-methyl-1H-benzotriazole-1-methanamine, CAS registration number 94270-86-70, sold commercially by BASF under the trade name Irgamet™ 39;

(ii) One or more fatty acids derived from animal and/or vegetable sources, and/or the hydrogenated forms of such fatty acids, for example Neo-Fat™ which is commercially available from AKZO Nobel Chemicals, Ltd.

Suitable corrosion inhibitors include one or more of:

(i) N-Methyl-N-(1-oxo-9-octadecenyl)glycine, CAS registration number 110-25-8;

(ii) Phosphoric acid, mono- and diisooctyl esters, reacted with tert-alkyl and (C12-C14) primary amines, CAS registration number 68187-67-7;

(iii) Dodecanoic Acid;

(iv) Triphenyl phosphorothionate, CAS registration number 597-82-0; and (v) Phosphoric acid, mono- and dihexyl esters, compounds with tetramethylnonylamines and C11-14 alkylamines.

In one embodiment, the metal passivator is comprised of a corrosion additive and a metal deactivator. One useful additive is the N-acyl derivative of sarcosine, such as an N-acyl derivative of sarcosine. One example is N-methyl-N-(1-oxo-9-octadecenyl) glycine. This derivative is available from BASF under the trade name SARKOSYL™ O. Another additive is an imidazoline such as Amine O™ commercially available from BASF.

The metal passivator may be present in the composition from 0.01% to 6.0% or from 0.02%, to 0.1%. The additive may be present in the composition at 0.05% or less. These various ranges are typically applied to all of the metal passivator additives present in the overall composition. However, in some embodiments, these ranges may also be applied to individual corrosion inhibitors and/or metal deactivators. The ranges above may also be applied to the combined total of all corrosion inhibitors, metal deactivators and antioxidants present in the overall composition.

The compositions described herein may also include one or more additional performance additives. Suitable additives include antiwear inhibitors, rust/corrosion inhibitors and/or metal deactivators (other than those described above), pour point depressants, viscosity improvers, tackifiers, extreme pressure (EP) additives, friction modifiers, foam inhibitors, emulsifiers, demulsifiers and acid catchers.

To aid in preventing wear on the metal surface, the present invention may utilize anti-wear inhibitor/extreme pressure (EP) additive and friction modifiers. Anti-wear inhibitors, EP additives, and friction modifiers are available off the shelf from a variety of vendors and manufacturers. Some of these additives may perform more than one task. One product that may provide anti-wear, EP, reduced friction and corrosion inhibition is phosphorus amine salt such as Irgalube™ 349, which is commercially available from BASF. Another anti-wear/EP inhibitor/friction modifier is a phosphorus compound such as is triphenyl phosphothionate (TPPT), which is commercially available from BASF under the trade name Irgalube TPPT. Another anti-wear/EP inhibitor/friction modifier is a phosphorus compound such as is tricresyl phosphate (TCP), which is commercially available from Chemtura under the trade name Kronitex™ TCP. Another anti-wear/EP inhibitor/friction modifier is a phosphorus compound such as is t-butylphenyl phosphate, which is commercially available from ICL Industrial Products under the trade name Syn-O-Ad 8478. The anti-wear inhibitors, EP, and friction modifiers are typically 0.1% to 4% of the composition and may be used separately or in combination.

In some embodiments, the composition further includes an additive from the group comprising: viscosity modifiers include ethylene vinyl acetate, polybutenes, polyisobutylenes, polymethacrylates, olefin copolymers, esters of styrene maleic anhydride copolymers, hydrogenated styrene-diene copolymers, hydrogenated radial polyisoprene, alkylated polystyrene, fumed silicas, and complex esters; and tackifiers like natural rubber solubilized in oils.

The addition of a viscosity modifier, thickener, and/or tackifier provides adhesiveness and improves the viscosity and viscosity index of the lubricant. Some applications and environmental conditions may require an additional tacky surface film that protects equipment from corrosion and wear. In this embodiment, the viscosity modifier, thickener/tackifier is 1 to 20 wt % of the lubricant. However, the viscosity modifier, thickener/tackifier may be from 0.5 to 30 wt %. An example of a material Functional V-584 a Natural Rubber viscosity modifier/tackifier, which is available from Functional Products, Inc., Macedonia, Ohio. Another example is a complex ester CG 5000 that is also a multifunctional product, viscosity modifier, pour point depressant, and friction modifier from Inolex Chemical Co. Philadelphia, Pa.

Other oils and/or components may be also added to the composition in the range of 0.1 to 75% or even 0.1 to 50% or even 0.1 to 30%. These oils could include white petroleum oils, synthetic esters (as described in patent U.S. Pat. No. 6,534,454), severely hydro-treated petroleum oil (known in the industry as "Group II or III petroleum oils"), esters of one or more linear carboxylic acids, polyalphaolefin (PAO) base oils, alkyl benzene base oils, polyalkylene glycol (PAG) base oils, alkylated naphthalene base oils, or any combination thereof.

The lubricant can be used in a gas compressor system, where the gas compressor system includes a compressor and a working fluid, where the working fluid includes a lubricant and a gas.

The lubricant may also be able to allow for providing a method of operating a gas compressor system. The described method includes the step of: supplying to the gas compressor system a working fluid that includes a lubricant and a gas.

The lubricant can be used in a refrigeration system, where the refrigeration system includes a compressor and a working fluid, where the working fluid includes a lubricant and a refrigerant. Any of the working fluids described above may be used in the described refrigeration system.

The lubricant may also be able to allow for providing a method of operating a refrigeration system. The described method includes the step of: (I) supplying to the refrigeration system a working fluid that includes a lubricant and a refrigerant. Any of the working fluids described above may be used in the described methods of operating any of the described refrigeration systems.

The present methods, systems and compositions are thus adaptable for use in connection with a wide variety of heat transfer systems in general and refrigeration systems in particular, such as air-conditioning (including both stationary and mobile air conditioning systems), refrigeration, heat-pump, or gas compression systems such as are used in hydrocarbon gas processing or industrial gas processing systems. As used herein, the term "refrigeration system" refers generally to any system or apparatus, or any part or portion of such a system or apparatus, which employs a refrigerant to provide cooling and/or heating. Such refrigeration systems include, for example, air conditioners, electric refrigerators, chillers, or heat pumps.

TABLE 9

Gas Compressor Lubricant compositions

| | Embodiments (wt %) | | |
|---|---|---|---|
| Additive | A | B | C |
| Seal Swell Agent of the invention (compound of formula (I)) | 0.01 to 2.0 | 0.02 to 1.5 | 0.05 to 1.5 |
| Antioxidant | 0 to 6.0 | 0.01 to 3.0 | 0.03 to 2 |
| Antiwear/EP Agent | 0 to 4.0 | 0.0 to 2 | 0.1 to 1.0 |
| Metal Deactivator/ Corrosion Inhibitor | 0 to 6 | 0.0 to 0.5 | 0.015 to 0.1 |
| Oil of Lubricating Viscosity | Balance to 100% | Balance to 100% | Balance to 100% |

In order to demonstrate improved performance of the refrigerant composition, the composition may be evaluated versus control standards as to ASTM D471-12a Standard Test Method for Rubber Property—Effect of Liquids.

The invention also provides for a method of preparing the lubricating compositions disclosed herein. The method comprises mixing a compound of formula (I) with an oil of lubricating viscosity. Further additives as disclosed above can be mixed in as well. This method is effectively a method of improving the elastomer seal compatibility of the oil of lubricating viscosity. The presence of the compound of formula (I) imparts seal swelling properties to the oil of lubricating viscosity.

The invention also provides for a method of lubricating a mechanical device which has a seal in contact with a lubricating composition, which method comprises supplying to said device the composition of the invention either as the lubricating composition or as an additive concentrate to the lubricating composition. The method can involve an additional step of operating the mechanical device. The device can be a driveline device such as an automatic transmission, wherein the lubricating composition is an automatic transmission fluid. The device can be an internal combustion engine, wherein the lubricating composition is an engine oil. In one embodiment the lubricant composition is a grease composition and the invention provides a method of lubricating a mechanical device with a grease composition comprising supplying to the mechanical device a grease composition as disclosed herein.

In one embodiment the invention provides a method of lubricating a hydraulic system, comprising supplying to the hydraulic system a lubricant composition as disclosed herein.

In one embodiment the invention provides a method of lubricating a turbine system, comprising supplying to the turbine system a lubricant composition as disclosed herein.

In one embodiment the invention provides a method of lubricating a circulating oil system, comprising supplying to the circulating oil system a lubricant composition as disclosed herein.

In one embodiment the invention provides a method of lubricating industrial gears comprising supplying to the industrial gears a lubricant composition as disclosed herein.

In one embodiment, the invention provides a method of lubricating a gas compressor comprising supplying to the gas compressor a lubricant composition as described herein.

In one embodiment, the invention provides a method of lubricating a refrigeration system comprising supplying to the refrigeration system a lubricant composition as disclosed herein.

The invention also provides for a method of swelling an elastomer seal when in contact with a lubricating composition, said method comprising adding to said lubricating composition a compound of formula (I) or an additive concentrate according to the invention. The invention thus provides for the use of a compound according to formula (I) as a seal swelling agent in a lubricating composition. In one embodiment the invention provides for the use of a compound of formula (I) as a seal swell agent in a lubricant composition, for example a grease composition. The lubricant composition can be suitable for use in a hydraulic system, turbine system, circulating oil system, gas compressor, refrigeration system or industrial gears.

The seal may be an elastomer seal. Typical elastomer materials include fluoroelastomers, polyacrylates and nitrile polymers.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group. In one embodiment, there are no halo substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The following examples provide illustrations of the disclosed technology. These examples are non-exhaustive and are not intended to limit the scope of the disclosed technology.

Preparative Examples

Compound A: 3,3'-sulfonylbis(N-(2-ethylhexyl)aniline)

3,3'-Sulfonylbis(N-(2-ethylhexyl)aniline) is prepared by reacting bis(3-aminophenyl)sulfone (150 g, 0.606 mol) with 2-ethylhexanal (157 g, 1.224 mol) to generate the corresponding imine. The imine is then reduced in situ with sodium borohydride (48 g, 1.273 mol) to give the desired product as a yellowish orange viscous liquid.

Compound B: 3,3'-sulfonylbis(N-octylaniline)

The compound is prepared by reacting bis(3-aminophenyl)sulfone (150 g, 0.606 mol) with octanal (157 g, 1.224 mol) to generate the corresponding imine. The imine is then reduced in situ with sodium borohydride (48 g, 1.273 mol) to give the desired product as a yellowish orange viscous liquid.

Compound C: 4,4'-sulfonylbis(N-(2-ethylhexyl)aniline)

The compound is prepared by reacting bis(4-aminophenyl)sulfone (150 g, 0.606 mol) with 2-ethylhexanal (157 g, 1.224 mol) to generate the corresponding imine. The imine is then reduced in situ with sodium borohydride (48 g, 1.273 mol) to give the desired product as a yellowish orange viscous liquid.

Compound D: 3,3'-sulfonylbis(N-decylaniline)

The compound is prepared by reacting bis(3-aminophenyl)sulfone (150 g, 0.606 mol) with decanal (191 g, 1.224 mol) to generate the corresponding imine. The imine is then reduced in situ with sodium borohydride (48 g, 1.273 mol) to give the desired product as a yellowish orange viscous liquid.

Compound E: Sulfonylbis(4,1-phenylene) bis(2-ethylhexanoate)

The compound is prepared by reacting 4,4'-sulfonyldiphenol (100 g, 0.400 mol) with 2-ethylhexanoyl chloride (133 g, 0.819 mol) in the presence of triethylamine (121 g, 1.2 mol) in dichloromethane (800 g) at 0° C. The reaction was allowed to warm up to room temperature and stirred at room temperature until the starting material was fully consumed. The reaction was washed with sodium bicarbonate (2×), followed by brine. The reaction was dried with anhydrous magnesium sulfate, filtered and the solvent was stripped under reduced pressure to afford a white solid.

Compound F: (NE,N'E)-4,4'-sulfonylbis(N-(2-ethylhexylidene)aniline)

The compound is prepared by a condensation reaction between bis(4-aminophenyl)sulfone (150 g, 0.606 mol) and 2-ethylhexanal (157 g, 1.224 mol) with water generated being removed azeotropically as a toluene/water mixture. The desired product was obtained as a yellowish orange viscous liquid.

Compound G: (NE,N'E)-3,3'-sulfonylbis(N-(2-ethylhexylidene)aniline)

The compound is prepared by a condensation reaction between bis(3-aminophenyl)sulfone (150 g, 0.606 mol) and 2-ethylhexanal (157 g, 1.224 mol) with water generated being removed azeotropically as a toluene/water mixture. The desired product was obtained as a yellowish orange viscous liquid.

Compound H: 1,1'-(sulfonylbis(4,1-phenylene))bis (3-hexadecenylpyrrolidine-2,5-dione)

The compound is prepared by a reacting bis(4-aminophenyl)sulfone (160 g, 0.644 mol) with hexadecyl succinic anhydride (HDSA, 428 g, 1.321 mol) in toluene. The reaction was heated to reflux for 5 hours during which water generated was removed via a Dien-Stark apparatus. The solvent was removed under reduced pressure to give the desired product as a yellowish orange viscous liquid.

Compound I: 1,1'-(sulfonylbis(3,1-phenylene))bis(3-hexadecenylpyrrolidine-2,5-dione)

The compound is prepared by a reacting bis(3-aminophenyl)sulfone (160 g, 0.644 mol) with hexadecyl succinic anhydride (HDSA, 428 g, 1.321 mol) in toluene. The reaction was heated to reflux for 5 hours during which water generated was removed via a Dien-Stark apparatus. The solvent was removed under reduced pressure to give the desired product as a yellowish orange viscous liquid.

Examples 1 to 21—Automatic Transmission Fluids

Several lubricating compositions are prepared based on the formulation given below which represents a typical or conventional lubricant for an automatic transmission. Each of the components other than the oil being presented in an oil-free basis, and all the percentages being by weight:

| Oil of lubricating viscosity: in an amount to total 100% | |
|---|---|
| Antioxidants: | 1.0 |
| Antiwear component: | 0.28 |
| Corrosion inhibitors: | 0.245 |
| Detergents: | 0.23 |
| Dispersants: | 3.04 |
| Friction adjustor: | 0.11 |
| Friction modifiers: | 1.22 |
| Pour point depressant: | 0.2 |
| Antifoams: | 135 ppm |

The lubricating compositions differ in the type of oil of lubricating viscosity that is used and in the amount/identity of further additive added as shown in Table 10. The compositions which are examples of the present invention contain one of compounds A to F, which are compounds according to formula (I). The reference examples contain a commercially available seal swell agent (sulfolene compound) which is a C10-rich 3-(C9-11-isoalkyloxy) derivative of tetrahydrothiophene 1,1-dioxide.

TABLE 10

| | Oil of lubricating viscosity | Additive* | Amount of additive (wt %) |
|---|---|---|---|
| Example 1 | PAO-4 | Compound A | 1.5 |
| Reference Example 1 | PAO-4 | Sulfolene Compound | 1.5 |
| Example 2 | PAO-4 | Compound A | 0.3 |
| Example 3 | PAO-4 | Compound A | 0.9 |
| Example 4 | PAO-4 | Compound A | 1.5 |
| Example 5 | Group III | Compound A | 0.3 |
| Example 6 | Group III | Compound A | 0.9 |
| Example 7 | Group III | Compound A | 1.5 |
| Example 8 | GTL | Compound A | 0.3 |
| Example 9 | GTL | Compound A | 0.9 |
| Example 10 | GTL | Compound A | 1.5 |
| Example 11 | PAO-4 | Compound A | 0.3 |
| Example 12 | PAO-4 | Compound A | 0.5 |
| Example 13 | PAO-4 | Compound A | 0.75 |
| Reference Example 2 | PAO-4 | Sulfolene Compound | 0.5 |
| Reference Example 3 | PAO-4 | Sulfolene Compound | 0.75 |
| Example 14 | PAO-4 | Compound A | 0.35 |
| Exampl 15 | PAO-4 | Compound A | 0.45 |
| Example 16 | PAO-4 | Compound B | 1.5 |
| Example 17 | PAO-4 | Compound C | 1.5 |
| Example 18 | PAO-4 | Compound D | 1.5 |
| Example 19 | GTL | Compound E | 1.5 |
| Example 20 | GTL | Compound F | 1.5 |

*the structures of compounds A to F are shown in Table 1

The efficacy of each candidate compound as a seal swell agent was assessed by blending the candidate into an automatic transmission fluid. The degree of elastomer compatibility was determined as per the test methods outlined in Appendix B of the DEXRON®-VI specification (GMW16444, April 2014, available from General Motors). SAE approved Standard Reference Elastomers (SRE) were used.

The original volume measurement and Durometer readings (ASTM D4289) of each elastomer were recorded. Individual pieces of elastomer were suspended in 300 ml of the formulation under test, at 150° C.±1° C. for 504 hours. After a sample clean up step to remove surface lubricant, the volume and Durometer readings of each elastomer were repeated. At the end of the test, the degree of volume change (i.e., swelling or shrinkage), expressed as a percentage, and the hardness change, expressed as a points value, of the elastomeric seal material. A reference oil is tested simultaneously using the same elastomers. The test is designed to determine the compatibility of the lubricating compositions with elastomeric seal materials. The test is carried out using a range of elastomers, including fluoroelastomers, polyacrylates and nitriles.

Experiment 1

In this first experiment, the elastomeric seal compatibility of a composition according to the invention is compared to that of a corresponding composition which contains a known (commercially available) seal swell agent instead of an additive according to formula (I). The test method is carried out on the Ni (nitrile) elastomer and the results are shown in Table 11. For volume change, a positive number (percent) indicates that the elastomer material has undergone a positive volume change. For hardness change, a lower number indicates that the elastomer material has increased in suppleness. The results in Table 11 show that the elastomer material swells more (i.e., it has a percentage increase in volume which is fourteen times greater) and is more supple after the test when the composition of the invention is used compared to when the composition of Reference Example 1 is used.

TABLE 11

| | Volume change (%) | Hardness change (points) |
|---|---|---|
| Example 1 | 9.93 | −8 |
| Reference Example 1 | 0.69 | −3 |

Experiment 2

In the second experiment, compositions according the invention using different amounts of compound A and different base oils are tested. The test method is carried out on the Ni (nitrile) elastomer and the results are shown in Table 12. These results show that for the base oils having little natural seal swelling properties such as gas to liquid (GTL) and PAO-4, more of the additive of formula (I) is required to achieve swelling of the elastomeric material.

TABLE 12

| | Volume change (%) |
|---|---|
| Example 2 (PAO-4, 0.3 wt % Compound A) | −0.63 |
| Example 7 (PAO-4, 0.9 wt % Compound A) | 5.64 |
| Example 1 (PAO-4, 1.5 wt % Compound A) | 10.31 |
| Example 8 (Group III, 0.3 wt % Compound A) | 1.44 |
| Example 9 (Group III, 0.9 wt % Compound A) | 7.04 |
| Example 10 (Group III, 1.5 wt % Compound A) | 12.12 |
| Example 11 (GTL, 0.3 wt % Compound A) | −0.39 |
| Example 12 (GTL, 0.9 wt % Compound A) | 5.41 |
| Example 13 (GTL, 1.5 wt % Compound A) | 11.11 |

Experiment 3

In the third experiment, compositions according the invention are compared to corresponding compositions comprising a known seal well agent instead of a compound according to formula (I). The oil of lubricating viscosity used in each of the compositions is PAO-4. The test method is carried out over a range of treat rates and for the full range of elastomeric materials listed in the Dexron VI test. The results are shown in Tables 13 (volume change) and 8 (hardness change).

TABLE 13

| Elastomer type | Ex. 11 0.3 wt % Cpd A in PAO-4 | Ex. 12 0.5 wt % Cpd A in PAO-4 | Ex. 13 0.75 wt % Cpd A in PAO-4 | Ref. Ex. 2 0.5 wt % sulfolene cpd in PAO-4 | Ref. Ex. 3 0.75 wt % sulfolene cpd in PAO-4 |
|---|---|---|---|---|---|
| V1 (Viton ™) fluoroelastomer | 5.13 | 5.96 | 6.96 | 4.86 | 5.77 |
| V2 (Viton ™) fluoroelastomer | 4.88 | 3.04 | 6.86 | 2.17 | 1.48 |
| V3 (Viton ™) fluoroelastomer | 4.55 | 6.25 | 7.41 | 5.12 | 5.87 |
| P1 polyacrylate | 3.11 | 4.72 | 6.64 | 2.55 | 2.79 |
| P2 polyacrylate | 3.76 | 5 | 6.34 | 2.53 | 3.34 |
| P3 polyacrylate | 0.7 | 2.72 | 4.42 | 0.48 | 0.96 |
| F1 fluoroelastomer | 1.72 | 2.08 | 2.44 | 1.79 | 2.17 |
| F2 fluoroelastomer | 1.59 | 2.07 | 2.47 | 1.78 | 2.23 |
| Ni nitrile | −0.55 | 1.43 | 3.99 | −2.16 | −1.45 |

TABLE 14

| Elastomer type | Ex. 11 0.3 wt % Cpd A in PAO-4 | Ex. 12 0.5 wt % Cpd A in PAO-4 | Ex. 13 0.75 wt % Cpd A in PAO-4 | Ex. 14 0.5 wt % sulfolene cpd in PAO-4 | Ex. 15 0.75 wt % sulfolene cpd in PAO-4 |
|---|---|---|---|---|---|
| V1 (Viton ™) fluoroelastomer | −1 | −1 | −1 | −4 | −2 |
| V2 (Viton ™) fluoroelastomer | 0 | 1 | 0 | 0 | 1 |
| V3 (Viton ™) fluoroelastomer | −2 | −2 | −3 | −4 | −3 |
| P1 polyacrylate | −2 | −1 | −4 | −5 | −4 |
| P2 polyacrylate | 0 | 0 | −2 | −2 | −3 |
| P3 polyacrylate | 0 | 0 | −3 | −3 | −2 |

TABLE 14-continued

| Elastomer type | Ex. 11 0.3 wt % Cpd A in PAO-4 | Ex. 12 0.5 wt % Cpd A in PAO-4 | Ex. 13 0.75 wt % Cpd A in PAO-4 | Ex. 14 0.5 wt % sulfolene cpd in PAO-4 | Ex. 15 0.75 wt % sulfolene cpd in PAO-4 |
|---|---|---|---|---|---|
| F1 fluoroelastomer | 3 | 3 | 3 | 2 | 1 |
| F2 fluoroelastomer | 3 | 4 | 3 | 2 | 0 |
| Ni nitrile | −1 | −3 | −5 | −2 | −1 |

Experiment 4

In the fourth experiment, compositions according the invention are tested over a range of treat rates of compound A. The oil of lubricating viscosity is PAO-4 in each of the compositions. The test method is carried out for the Ni (nitrile) elastomer. The results are shown in Table 15.

TABLE 15

| | Volume change (A) | Hardness change (points) |
|---|---|---|
| Example 14 (PAO-4, 0.35 wt % of compound A) | 0.08 | −3 |
| Example 15 (PAO-4, 0.45 wt % of compound A) | 0.82 | −7 |

Experiment 5

In the fifth experiment, compositions according the invention are tested. The oil of lubricating viscosity used is either PAO-4 or GTL and the compound of formula (I) is one of compounds B to F. The test method is carried out for the Ni (nitrile) elastomer. The results are shown in Table 16.

TABLE 16

| | Volume change (%) | Hardness change (points) |
|---|---|---|
| Example 16 (PAO-4, 1.5 wt % of compound B) | 9.35 | −8 |
| Example 17 (PAO-4, 1.5 wt % of compound C) | 9.28 | −6 |
| Example 18 (PAO-4, 1.5 wt % of compound D) | 6.28 | −6 |
| Example 19 (GTL, 1.5 wt % of compound E) | 2.89 | −2 |
| Example 20 (GTL, 1.5 wt % of compound F) | 6.92 | −2 |

Example 21—Off-Highway Lubricating Composition

A lubricating composition is prepared based on the formulation given below in Table 17 which represents a typical or conventional lubricant for a transmission for an off-highway vehicle. Each of the components other than the oil being presented in an oil-free basis, and all the percentages being by weight.

TABLE 17

| Example 21—Components | (wt %) |
|---|---|
| Succinimide dispersant | 0.29 |
| Ester based dispersant | 0.29 |
| Ca sulfonate detergents | 1.25 |
| Ca phenate detergent | 0.64 |
| Zn based dithiophosphate antiwear agent | 2.52 |
| Pour point depressant, antifoam agents and demulsifiers | 10.703 |
| Compound A | 0.46 |
| Group I base oil | Balance to 100 |

Experiment 6

ASTM D471 is used to evaluate the compatibility of an Off-Highway fluid with a number of different elastomers. ASTM D2240 is used to determine the Shore A hardness of the elastomer test piece. The volume and the Shore A hardness of the elastomer test pieces are determined before immersing the test pieces in the candidate fluid for 100 hours at 100° C. Likewise, the Shore A hardness of each elastomer is determined after the material was suspended in the candidate fluid. For the formulation of Example 21, for a Ni nitrile seal swell the test results where a volume change: +4.9% (average of three tests, 4.83, 4.83 and 5.03%) & average hardness change: −4 points.

Examples 22 to 25—Engine Lubricants

A series of 5W-20 lubricating compositions are prepared according to Table 18 below.

TABLE 18

| | Ref. Ex 4 | Ex 22 | Ex 23 | Ex 24 | Ex 25 |
|---|---|---|---|---|---|
| Group II base oil | Balance to 100% | | | | |
| 3-(decyloxy)tetrahydrothiophene 1,1-dioxide | 0.5 | | | | |
| Compound A | | 0.5 | | | |
| Compound B | | | 0.5 | | |
| Compound C | | | | 0.5 | |
| Compound D | | | | | 0.5 |
| C3/6 Secondary ZDDP | 0.75 | 0.75 | 0.75 | 0.75 | 0.75 |
| 600 TBN Overbased Ca sulfonate[1] | 0.86 | 0.86 | 0.86 | 0.86 | 0.86 |
| 15 TBN PIB succinimide dispersant[2] | 2 | 2 | 2 | 2 | 2 |
| Hindered phenol antioxidant | 0.7 | 0.7 | 0.7 | 0.7 | 0.7 |
| Ashless Antioxidant[3] | 0.8 | 0.8 | 0.8 | 0.8 | 0.8 |
| Other Additives[4] | 0.75 | 0.75 | 0.75 | 0.75 | 0.75 |
| % Ca | 0.21 | 0.21 | 0.21 | 0.21 | 0.21 |
| % P | 0.076 | 0.076 | 0.076 | 0.076 | 0.076 |
| % Sulfated Ash | 0.6 | 0.6 | 0.6 | 0.6 | 0.6 |

[1]Blend of 520 TBN and 690 TBN materials

[2]PIBsuccinimide (polymer Mn ~2200) with TBN 27

[3]Ashless antioxidant includes a mixture of alkylated diarylamine and sulfurized olefin.

[4]Other additives include viscosity index improver, pourpoint depressant, foam inhibitor, and supplemental friction modifier The compositions of the present invention exhibit several advantages. Engine seals, for example, particularly in older vehicles, have a tendency to dry out and shrink over time, and a powerful seal swell agent may effectively re-swell and soften the dried seals, regenerating them so they will perform their originally intended function. Seal swell agents are useful, for example, in preventing deterioration of both Viton™ and nitrile rubber seals, as evaluated in the MTU (Michigan Technical University) seal screen test in a passenger car motor oil GF5 formulation, in which all candidates are evaluated initially at 0.5% concentration in the blend as a typical treat level at which seal swell performance is evaluated.

In one series of tests, certain seal swell/conditioning agents of the invention are evaluated with aged seals. Virgin seals are first subjected to prolonged high temperature oxidation for one week in typical oil formulations, until they have "aged" and developed characteristic surface cracking to various degrees. Then, the lubricant blends are replaced with similar formulations containing the seal swell/conditioning agents, and the testing is continued for an additional week. For certain agents, the surface appearance of the elastomeric seals is found to be stable, with no further deterioration in appearance or cracking.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the term "comprising" is intended also to encompass as alternative embodiments "consisting essentially of" and "consisting of." "Consisting essentially of" permits the inclusion of substances that do not materially affect the basic and novel characteristics of the composition under consideration.

What is claimed is:

1. A method of lubricating a driveline device or an internal combustion engine which has a seal in contact with a lubricating composition, said method comprising supplying the lubricating composition to the driveline device or the internal combustion engine, wherein the lubricating composition comprises an oil of lubricating viscosity and about 0.01 to about 2 weight percent of a compound represented by formula (I), based upon the weight of the lubricating composition, (I)

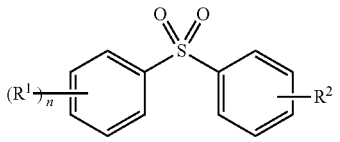

wherein:

n is 0 or 1;

$R^1$ and $R^2$ are each independently a group represented by $R^3$ or $R^4_p$—Y;

$R^3$ is a hydrocarbyl group of about 4 to about 20 carbon atoms;

$R^4$ is an alkylene group of about 1 or 2 carbon atoms;

p is 0 or 1;

—Y is —Z—$R^5$ where —Z— is chosen from —NH—, —N($R^6$)— where $R^6$ is a hydrocarbyl group of about from 6 to about 18 carbon atoms, —N═CH—, —HC═N—, —O—C(O)—, and —C(O)—O—; and $R^5$ is hydrogen or an aliphatic hydrocarbyl group of about 4 to about 20 carbon atoms; or —Y is represented by formula (II)

(II)

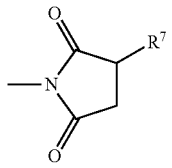

where $R^7$ is a hydrocarbyl group containing from about 8 to about 100 carbon atoms.

2. The method of claim 1, wherein when n is 1 and $R^1$ and $R^2$ are each represented by the same group $R^4_p$—Z—$R^5$, where Z is chosen from —NH—, —N($R^6$)—, —N═CH—, —HC═N—; and (i) when Z is —N═CH— where $R^5$ (a) is not hydrogen nor an alkyl group containing 6, 9 or 10 carbon atoms and/or (b) is a hydrocarbyl group containing from 12 to 20 carbon atoms; and (ii) when Z is —NH—$R^5$, $R^5$ is a hydrocarbyl group containing from about 6 to about 20 carbon atoms.

3. The method of claim 1, wherein at least one of $R^1$ or $R^2$ contains a hydrocarbyl group having at least 4, 5, 6, 7 or 8 carbon atoms.

4. The method of claim 1, wherein at least one of $R^1$ and $R^2$ is represented by the group $R^4_p$—Y.

5. The method of claim 3, wherein at least one of $R^1$ and $R^2$ is represented by $R^4_p$—Z—$R^5$ and, Z is chosen from —NH—, —N═CH—, and —O—C(O)—.

6. The method of claim 1, wherein at least one of $R^1$ and $R^2$ is represented by $R^4_p$—Y where Y is of formula (II)

(II)

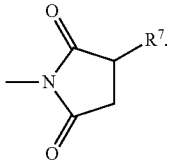

7. The method of claim 6, wherein in each group represented by formula (II) present, $R^7$ is a hydrocarbyl group containing about 14 to about 16 carbon atoms.

8. The method of claim 1, wherein n is 1 and, preferably, each of $R^1$ and $R^2$ is represented by the same group.

9. The method of claim 1, wherein n is 0.

10. The method of claim 1, wherein the oil of lubricating viscosity is a Gas-to-Liquid (Fischer-Tropsch) synthetic oil.

11. The method of claim 1, wherein the lubricating composition further comprises one or more components selected from the group of dispersants, detergents, metal salts of a phosphorus acid, friction modifiers, viscosity modifiers and antioxidants.

12. The method of claim 1, wherein the lubricating composition further comprises a metal salt of a carboxylic fatty acid chosen from a mono-hydroxycarboxylic acid, a di-hydroxycarboxylic acid, a poly-hydroxycarboxylic acid or mixtures thereof.

13. The method of claim 12, wherein the carboxylic fatty acid is a hydroxyl-substituted carboxylic acid or mixtures thereof.

14. The method of claim 13, wherein the hydroxyl-substituted fatty acid is 12-hydroxystearic acid.

15. The method of claim 1, wherein the lubricating composition further comprises:

(a) 0.0001 wt % to 0.15 wt % of a corrosion inhibitor chosen from 2,5-bis(tert-dodecyldithio)-1,3,4-thiadiazole, tolyltriazole, or mixtures thereof;

(b) 0.02 wt % to 3 wt % of an antioxidant chosen from aminic or phenolic antioxidants or mixtures thereof;

(c) 0 wt % to 1.5 wt % of a borated or non-borated succinimide dispersant;

(d) 0.001 wt % to 1.5 wt % of a neutral or overbased calcium naphthalene sulfonate; and (e) 0.001 wt % to 2 wt % of an antiwear agent chosen from zinc dialkyldithiophosphate, zinc dialkylphosphate, amine salt of a phosphorus acid ester, or mixtures thereof.

16. The method of claim 1, wherein the lubricating composition further comprises:

(a) 0.001 wt % to 0.1 wt % of a corrosion inhibitor chosen from 2,5-bis(tert-dodecyldithio)-1,3,4-thiadiazole, tolyltriazole, or mixtures thereof;

(b) 0.01 wt % to 1.5 wt % of an antioxidant chosen from aminic or phenolic antioxidants or mixtures thereof;

(c) 0.01 wt % to 2 wt % of a borated or non-borated succinimide dispersant;

(d) 0.001 wt % to 1.5 wt % of a neutral or slightly overbased calcium naphthalene sulfonate;

(e) 0.001 wt % to 1 wt % of a carboxylic acid or anhydride chosen from polyisobutylene succinic acid or anhydride, or dodecenyl succinic acid; and (f) 0.005 wt % to 1.5 wt % of an antiwear agent chosen from zinc dialkyldithiophosphate, zinc dialkylphosphate, amine salt of a phosphorus acid ester, or mixtures thereof.

17. The method of claim 1, wherein the lubricating composition further comprises:

(a) 0.0001 wt % to 0.15 wt % of a corrosion inhibitor chosen from 2,5-bis(tert-dodecyldithio)-1,3,4-thiadiazole, tolyltriazole, or mixtures thereof;

(b) 0.02 wt % to 3 wt % of an antioxidant chosen from aminic or phenolic antioxidants or mixtures thereof;

(c) 0.005 wt % to 1.5 wt % of a borated or non-borated succinimide dispersant;

(d) 0.001 wt % to 1.5 wt % of a neutral or slightly overbased calcium naphthalene sulfonate;

(e) 0.001 wt % to 2 wt % of an antiwear agent chosen form zinc dialkyldithiophosphate, zinc dialkylphosphate, amine salt of a phosphorus acid ester, or mixtures thereof; and (f) 0.01 to 5 wt % of an extreme pressure additive chosen from a sulfurized olefin and a polysulfide.

18. The method according to claim 1, wherein the seal is an elastomer chosen from a fluoroelastomer, a polyacrylate and a nitrile polymer.

* * * * *